US008276662B2

(12) United States Patent
Niconoff

(10) Patent No.: US 8,276,662 B2
(45) Date of Patent: Oct. 2, 2012

(54) SYSTEMS AND METHODS TO FILTER AND COLLECT DOWNHOLE FLUID

(75) Inventor: Mijail Barranco Niconoff, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 411 days.

(21) Appl. No.: 12/503,360

(22) Filed: Jul. 15, 2009

(65) Prior Publication Data

US 2011/0011583 A1 Jan. 20, 2011

(51) Int. Cl.
*E21B 49/08* (2006.01)
*E21B 34/08* (2006.01)

(52) U.S. Cl. ..... 166/264; 166/321; 166/375; 175/59; 73/152.25; 73/152.28; 137/625.29; 251/96; 251/108

(58) Field of Classification Search ..... 166/264, 166/100, 321, 237, 375; 175/59; 73/152.25, 73/152.28; 137/636.4, 625.17, 625, 625.29; 251/95, 96, 107, 108
See application file for complete search history.

(56) References Cited

U.S. PATENT DOCUMENTS 3,352,361 A * 11/1967 Urbanosky ..... 166/100
3,530,933 A * 9/1970 Whitten ..... 166/100
4,210,018 A * 7/1980 Brieger ..... 73/152.26
4,287,946 A * 9/1981 Brieger ..... 166/100
4,339,948 A * 7/1982 Hallmark ..... 73/152.26
4,416,152 A * 11/1983 Wilson ..... 73/152.26
4,417,622 A * 11/1983 Hyde ..... 166/264
4,507,957 A * 4/1985 Montgomery et al. .... 73/152.26
4,595,036 A * 6/1986 Johnston ..... 137/636.4
4,691,618 A * 9/1987 Poling ..... 91/326
4,893,505 A * 1/1990 Marsden et al. ..... 73/152.24
4,895,184 A * 1/1990 Abbey ..... 137/625.29
5,147,185 A * 9/1992 Niehaus et al. ..... 417/394
5,238,070 A * 8/1993 Schultz et al. ..... 166/386
5,473,939 A * 12/1995 Leder et al. ..... 73/152.12
6,457,698 B2 * 10/2002 Wichmann ..... 251/108
6,575,195 B2 * 6/2003 Wichmann ..... 137/625.17
7,080,552 B2 * 7/2006 Jones et al. ..... 73/152.27
7,155,967 B2 1/2007 Rylander et al.
7,188,687 B2 3/2007 Rudd et al.
RE39,583 E * 4/2007 Upchurch ..... 166/250.15
7,367,394 B2 * 5/2008 Villareal et al. ..... 166/264
7,503,385 B2 * 3/2009 Tips et al. ..... 166/72
7,841,310 B2 * 11/2010 Child ..... 123/90.15
7,845,405 B2 * 12/2010 Villareal et al. ..... 166/264
7,997,341 B2 * 8/2011 Briquet et al. ..... 166/264
8,056,625 B2 * 11/2011 Villareal et al. ..... 166/264
2001/0052367 A1 * 12/2001 Wichmann ..... 137/625.29
2002/0066574 A1 * 6/2002 Leismer et al. ..... 166/375
2003/0047221 A1 * 3/2003 Wichmann ..... 137/625.29
2003/0217845 A1 * 11/2003 Sherwood et al. ..... 166/264
2004/0055550 A1 * 3/2004 Smith ..... 123/90.17
(Continued)

*Primary Examiner* — Jennifer H Gay
(74) *Attorney, Agent, or Firm* — Cathy Hewitt; Michael Flynn; Jody Lynn DeStefanis

(57) ABSTRACT

The present disclosure is directed to the filtering and collection of downhole fluids. An example system to filter and sample downhole fluids includes a first sampling chamber that includes one or more cone-shaped filters to receive downhole fluid, filter the downhole fluid, and store the downhole fluid, a second sampling chamber, a spool valve to allow the downhole fluid to flow into the first sampling chamber in a first position and to redirect the downhole fluid to the second sampling chamber or a base block in a second position, and a setting line to selectively move the spool valve from the first position to the second position.

29 Claims, 12 Drawing Sheets

U.S. PATENT DOCUMENTS

2009/0283266 A1* 11/2009 Nold et al. ..... 166/264
2010/0193187 A1* 8/2010 Briquet et al. ..... 166/264
2011/0011583 A1* 1/2011 Niconoff ..... 166/264
2011/0139450 A1* 6/2011 Vasques et al. ..... 166/264

* cited by examiner

SYSTEMS AND METHODS TO FILTER AND COLLECT DOWNHOLE FLUID

BACKGROUND

In wellsite sampling and testing, downhole fluid retrieved from subterranean formations often includes particulate matter and/or objects that can damage sensitive downhole testing equipment. Current filtering solutions to filter particulate matter from the downhole fluid may become clogged very quickly, may be difficult to clean and/or replace, and/or may be tailored for a particular type of matter, all of which may result in these filtering solutions being ineffective, expensive and time consuming.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
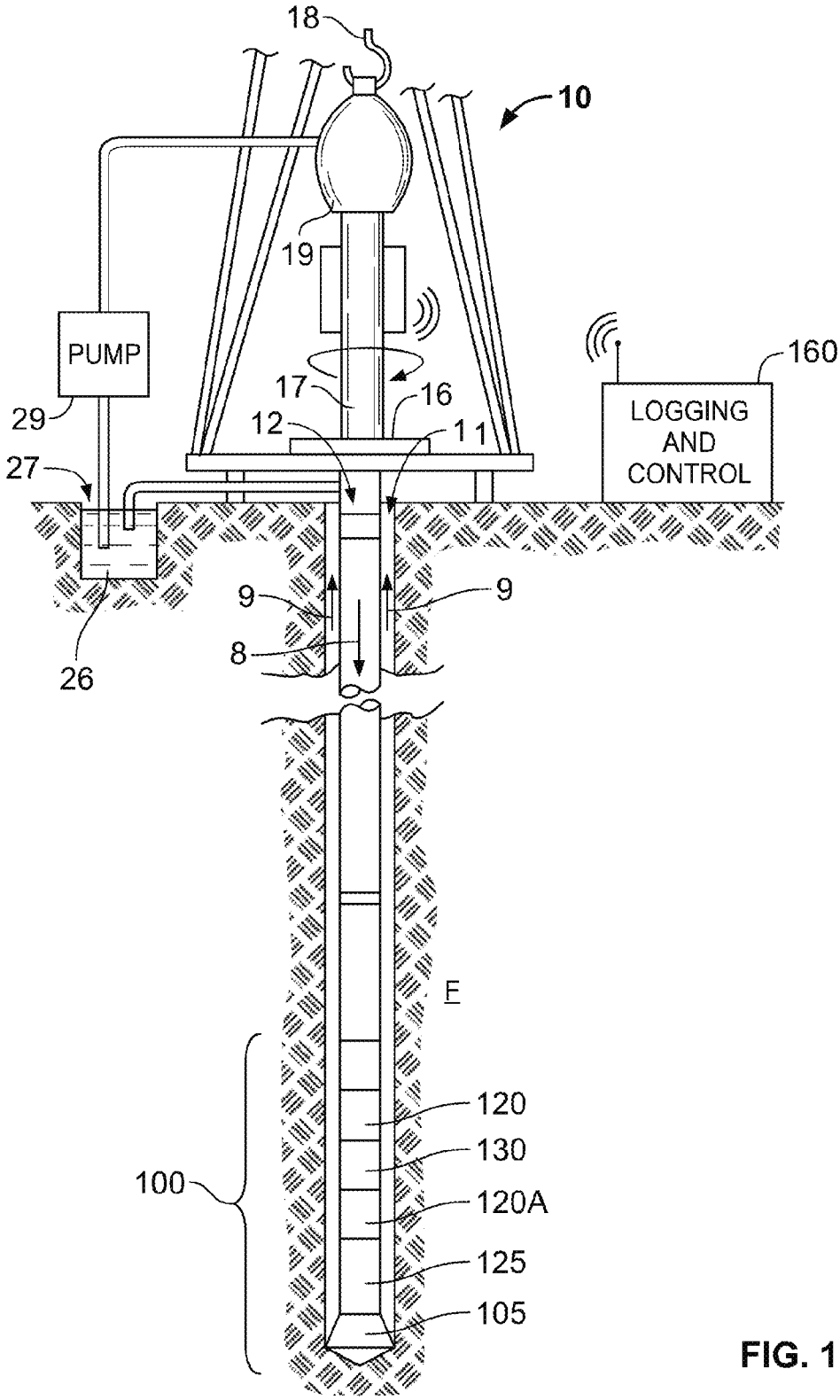
FIG. 1 is a schematic view of an example wellsite drilling system according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The example systems and methods described herein may be used to filter and collect downhole fluid samples retrieved from a subterranean formation. One or more sampling chambers may be coupled in series, where one of the sampling chambers may collect and/or filter downhole fluid at a given time such that a plurality of filtering and sampling operations may be performed. In other words, each of the sampling chambers may be used in a corresponding sampling operation. Of course, if desired, more than one sampling chamber may be used in connection with a given sampling operation.

The sampling chambers may each have one or more cone-shaped filters and the flow of downhole fluid into the sampling chambers may be controlled by respective spool valves. A spool valve may be initially in a first operating position in which the spool valve may direct downhole (e.g., formation) fluid from a first or inlet port to a sampling line on a second or outlet port. The spool valve may then be moved or otherwise controlled to be in a second operating position in which the spool valve may cut off or prevent the flow of fluid to the sampling line.

From the sampling line, the downhole fluid may flow into the sampling chamber, where the downhole fluid is filtered by one or more cone-shaped filters. A first cone-shaped filter to filter the downhole fluid may be the coarsest filter of the cone-shaped filters and may capture the largest matter or objects from the downhole fluid while allowing downhole fluid and smaller matter, particles and/or objects to pass through. Additional filters may capture progressively smaller objects and/or particles from the downhole fluid. In general, the cone shape of the filters may increase the surface area and volume to filter the downhole fluid and may also prevent clogging of the filters. Additionally, by passing the downhole fluid through multiple, progressively finer filters, the filters may be less likely to clog than a single filter configured to filter all fluids passing through the single filter.

When the downhole fluid has passed through all filters in the sampling chamber, the filtered fluid may be collected in a portion of the sampling chamber and/or may exit the sampling chamber to be collected in another portion of a downhole tool. When the sampling chamber is full or at some operator-determined time, the spool valve may be moved into the second or closed position to cut off or prevent fluid flow to the sampling chamber and redirect the downhole fluid to another spool valve and/or sampling chamber. To close the spool valve, the spool valve may provide a pressure port. In this manner, fluid (i.e., hydraulic) pressure may be applied to the pressure port on the spool valve to overcome a spring force holding the spool valve in the first, sampling or open position to move the spool valve to the second position. A locking pin may then lock the spool valve in the second position. If multiple spool valves have pressure ports that are fluidly coupled in parallel, the spool valves may have different spring pressures or forces to allow each of the spool valves to be moved to the second or closed position one at a time. That is, the spool valves may be operated (e.g., closed) in a desired sequence at different times to facilitate a downhole fluid filtering and/or sampling operation.

FIG. 1 illustrates an example wellsite drilling system that can be employed onshore and/or offshore. In the example wellsite system of FIG. 1, a borehole 11 is formed in one or more subsurface formations by rotary and/or directional drilling.

As illustrated in FIG. 1, a drillstring 12 is suspended in the borehole 11 and has a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drillstring 12 is rotated by the rotary table 16, energized by means not shown, which engages the kelly 17 at an upper end of the drillstring 12. The example drillstring 12 is suspended from the hook 18, which is attached to a traveling block (not shown), and through the kelly 17 and the rotary swivel 19, which permits rotation of the drillstring 12 relative to the hook 18. Additionally or alternatively, a top drive system could be used.

In the example depicted in FIG. 1, the surface system further includes drilling fluid 26, which is commonly referred to in the industry as "mud," which is stored in a pit 27 formed at the well site. A pump 29 delivers the drilling fluid 26 to the interior of the drillstring 12 via a port in the rotary swivel 19, causing the drilling fluid 26 to flow downwardly through the drillstring 12 as indicated by directional arrow 8. The drilling fluid 26 exits the drillstring 12 via ports in the drill bit 105, and then circulates upwardly through the annulus region between the outside of the drillstring 12 and the wall of the borehole 11 as indicated by directional arrows 9. The drilling fluid 26 lubricates the drill bit 105, carries formation cuttings up to the surface as it is returned to the pit 27 for recirculation, and creates a mudcake layer (not shown) (e.g., filter cake) on the walls of the borehole 11.

The example bottom hole assembly 100 of FIG. 1 includes, among other things, any number and/or type(s) of logging-while-drilling (LWD) modules or tools (two of which are designated by reference numerals 120 and 120A) and/or measuring-while-drilling (MWD) modules (one of which is designated by reference numeral 130), a rotary-steerable system or mud motor 125 and the example drill bit 105. The MWD module 130 measures the drill bit 105 azimuth and inclination that may be used to monitor the borehole trajectory.

The example LWD tools 120 and 120A of FIG. 1 are each housed in a special type of drill collar, as it is known in the art, and each contain any number of logging tools and/or fluid sampling devices. The example LWD tools 120 and 120A include capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with an extent of a zone invaded by the drilling fluid (e.g., filtrate), measurements obtained and/or predictions associated with sampling a formation F. While the logging and control computer 160 is depicted uphole and adjacent the wellsite system, a portion or all of the logging and control computer 160 may be positioned in the bottom hole assembly 100 and/or in a remote location.

Figure 2:
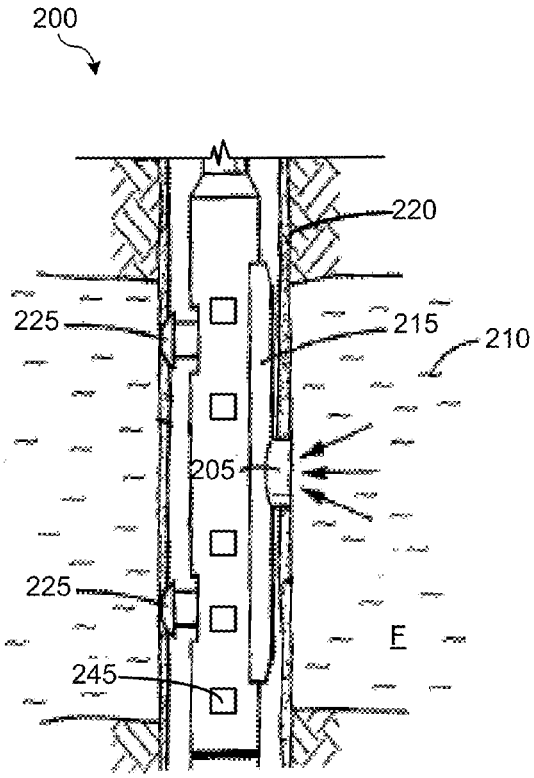
FIG. 2 is a schematic view showing an example manner of implementing either or both of the example logging while drilling modules of FIG. 1 according to one or more aspects of the present disclosure.

FIG. 2 is a simplified diagram of a sampling-while-drilling logging device 200 (LWD tool 200) that may be used to implement the LWD tools 120 and/or 120A. In the illustrated example, the LWD tool 200 is of a type described in U.S. Pat. No. 7,114,562, which is assigned to the assignee of the present patent and incorporated herein by reference in its entirety. However, other types of LWD tools can be used to implement the LWD tool 200 or part of an LWD tool.

The example LWD tool 200 of FIG. 2 is provided with a probe 205 configured to establish fluid communication with the formation F and to draw a fluid 210 into the LWD tool 200, as indicated by the arrows. The example probe 205 may be positioned, for example, within a stabilizer blade 215 of the LWD tool 200 and extend from the stabilizer blade 215 to engage a borehole wall 220. The example stabilizer blade 215 comprises one or more blades that are in contact with the borehole wall 220.

The LWD tool 200 may be provided with devices such as, for example, a chamber 245 for collecting fluid samples for retrieval at the surface. Backup pistons 225 may also be provided to assist in applying force to push the LWD tool 200 and/or the probe 205 against the borehole wall 220.

Figure 3:
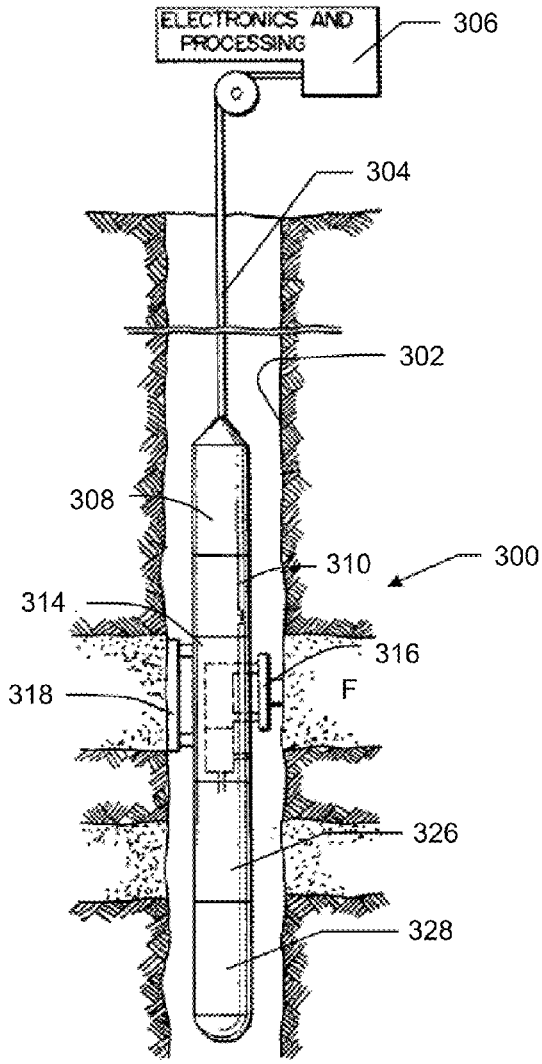
FIG. 3 is a schematic view of an example wireline measurement tool suspended in a well according to one or more aspects of the present disclosure.

FIG. 3 is an example wireline tool 300 that may be another environment in which aspects of the present disclosure may be implemented. The example wireline tool 300 is suspended in a wellbore 302 from the lower end of a multiconductor cable 304 that is spooled on a winch (not shown) at the Earth's surface. At the surface, the cable 304 is communicatively coupled to an electronics and processing system 306. The example wireline tool 300 includes an elongated body 308 that includes a formation tester 314 having a selectively extendable probe assembly 316 and a selectively extendable tool anchoring member 318 that are arranged on opposite sides of the elongated body 308. Additional components (e.g., 310) may also be included in the tool 300.

One or more aspects of the probe assembly 316 may be substantially similar to those described above in FIGS. 1 and 2. For example, the extendable probe assembly 316 is configured to selectively seal off or isolate selected portions of the wall of the wellbore 302 to fluidly couple to an adjacent formation F and/or to draw fluid samples from the formation F. The formation fluid may be expelled through a port (not shown) or it may be sent to one or more fluid collecting chambers 326 and 328. In the illustrated example, the electronics and processing system 306 and/or a downhole control system are configured to control the extendable probe assembly 316 and/or the drawing of a fluid sample from the formation F.

Figure 4:
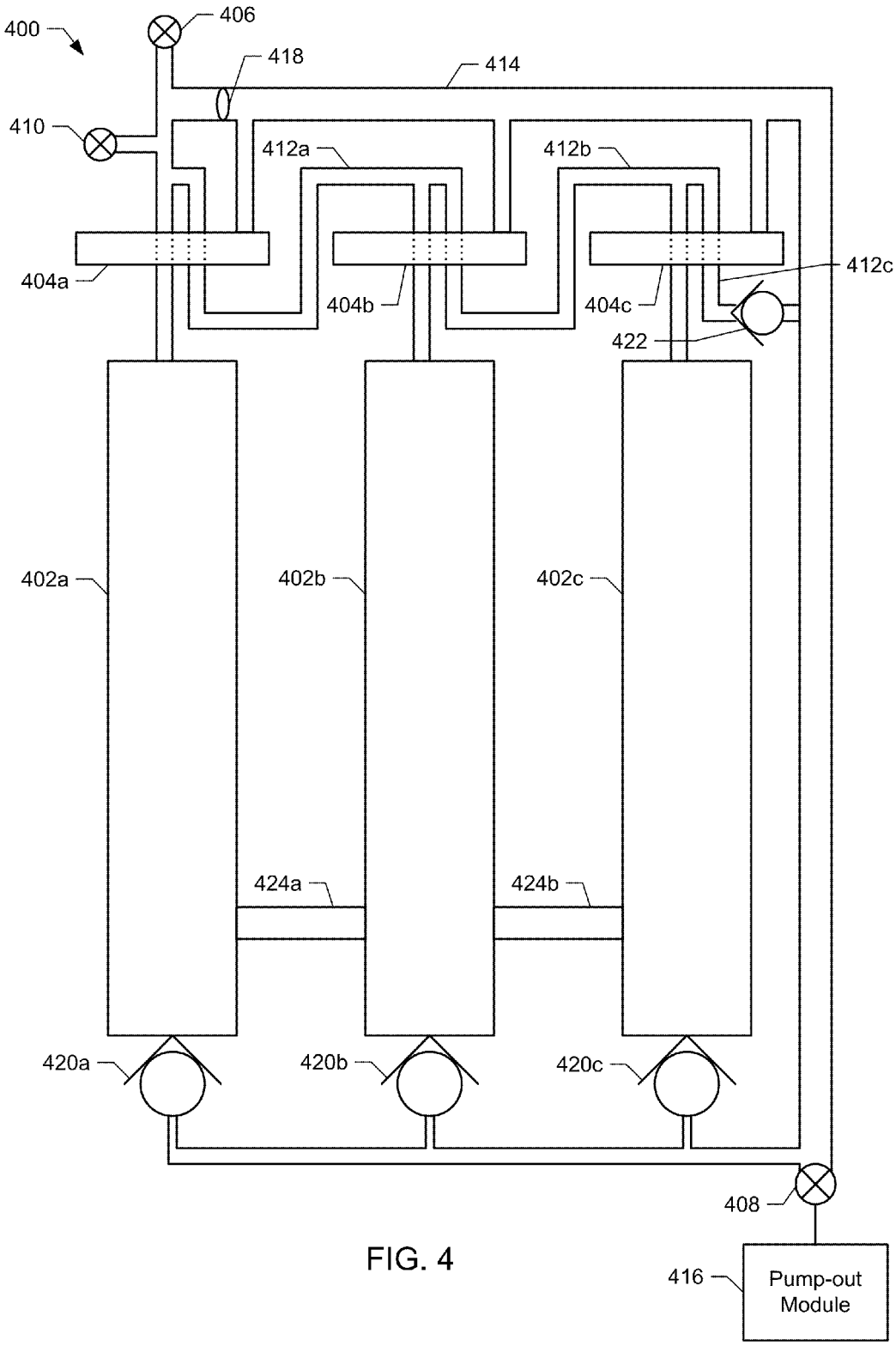
FIG. 4 is a schematic diagram of an example downhole filtering and sampling apparatus according to one or more aspects of the present disclosure.

FIG. 4 is a schematic diagram of an example downhole filtering and sampling apparatus 400. The example downhole filtering and sampling apparatus 400 may be disposed, for example, in a wireline tool such as the wireline tool 300 described in connection with FIG. 3. The example downhole filtering and sampling apparatus 400 receives downhole fluid from a subterranean formation (e.g., the formation F of FIGS. 1-3), filters the downhole fluid, and/or stores the downhole fluid in one or more sampling chambers 402*a*, 402*b*, and 402*c*, and/or another location for retrieval at a surface location. While these sampling chambers are depicted in FIG. 3, more or fewer sampling chambers may be used to suit a particular application. Further, the examples described below will be referred to as being disposed in a wireline tool such as the wireline tool 300 described in connection with FIG. 3. However, the examples described below may be readily disposed using the example MWD or LWD tools illustrated in FIG. 1 and, more generally, may be used in connection with any type of downhole conveyance including wireline, drillstrings, coiled tubing, etc.

The flow of downhole fluid into the sampling chambers 402*a*-402*c* is controlled by a plurality of spool valves 404*a*, 404*b*, and 404*c*. Generally, one spool valve 404*a*, 404*b*, or 404*c* is provided for each of the sampling chambers 402*a*-402*c* to control the flow of downhole fluid into the sampling chambers 402*a*-402*c*. However, multiple spool valves may be used with each chamber, if desired. Each example spool valve 404*a*, 404*b*, and 404*c* has two positions: a sampling, filtering or open position and a bypass or closed position. When the spool valve 404*a* is in the sampling, filtering or open position, downhole fluid may flow into the corresponding sampling chamber 402*a*. When the spool valve 404*a* is in the bypass position, downhole fluid is prevented from flowing into the sampling chamber 402*a* and instead is directed to flow to the next spool valve 404*b* in line. In other words, the sampling chambers 402*a*-402*c* and the spool valves 404*a*-404*c* are arranged in a series configuration to enable a cascade filtering and/or sampling operation with the chambers 402*a*-402*c*.

To allow downhole fluid into the example downhole filtering and sampling apparatus 400 (e.g., from the probe assembly 316 of FIG. 3), the downhole filtering and sampling apparatus 400 includes a seal valve 406. The seal valve 406 may be opened to allow downhole fluid to enter the filtering and sampling apparatus 400 or closed to cut off or prevent the flow of downhole fluid to the sampling and filtering apparatus 400 as needed to perform a downhole filtering and/or sampling operation. A second seal valve 408 may also be included to allow the flow of downhole fluid to other modules on the wireline tool 300 and/or to allow fluid into the downhole filtering and sampling apparatus 400. In the illustrated example of FIG. 4, downhole fluid flows from the seal valve 406 to the seal valve 408. A relief valve or bleed port 410 may be included to relieve pressure from the downhole filtering and sampling apparatus 400. For example, the relief valve 410 may be opened to relieve pressure to enable a sampling probe to disengage from a formation. The relief valve 410 may additionally or alternatively be used at the surface to relieve pressure on the chambers 402*a*-402*c* prior to disconnecting the downhole filtering and sampling apparatus 400 from the wireline tool 300.

The first spool valve 404*a* is fluidly coupled to the second spool valve 404*b* via a transfer line 412*a*. Similarly, the second spool valve 404*b* is fluidly coupled to the third spool valve 404*c* via a transfer line 412*b*. While the spool valve 404*a* is in the sampling position, the transfer line 412*a* does not have any fluid flowing therein. When the spool valve 404*a* is moved or operated to be in the bypass position, the transfer line 412*b* becomes fluidly coupled to the seal valve 406 via the spool valve 404*a*. Thus, with the spool valve 404*a* in the bypass position, downhole fluid may flow from the seal valve 406 through the spool valve 404*a* and the transfer line 412*a* to the spool valve 404*b*. Similarly, while the spool valve 404*b* is in the sampling position, the transfer line 412*b* does not have any fluid flowing therein. When the spool valve 404*b* is moved or operated to the bypass position and the spool valve 404*a* is already in the bypass position, the transfer line 412*b* becomes fluidly coupled to the seal valve 406 via the spool valves 404*a* and 404*b*. The downhole filtering and sampling apparatus 400 also includes a transfer line 412*c* to allow fluid to flow from the final spool valve 404*c* when the spool valve 404*c* is in the bypass position.

The example downhole filtering and sampling apparatus 400 further includes a setting line 414. As described in more detail below, the setting line 414 may be used by an operator of the downhole filtering and sampling apparatus 400 to control the spool valves 404*a*-404*c*, to bleed pressure and/or collect fluid from the sampling chambers 402*a*-402*c* and/or from the final spool valve (shown in FIG. 4 as the spool valve 404*c*), and/or to bypass one or more remaining sampling chambers 402*a*-402*c* to fluidly couple the seal valve 406 to the seal valve 408.

The operator of the downhole filtering and sampling apparatus 400 may increase the fluid (e.g., hydraulic fluid) pressure in the setting line 414 via a pump-out module 416 to cause one or more of the spool valves 404*a*-404*c* to move to the bypass position. The example pump-out module 416 is fluidly coupled to the setting line 414 via the seal valve 408 and, thus, may increase the fluid pressure in the setting line 414 when the seal valve 408 is open and the seal valve 406 is closed.

As depicted in FIG. 4, each of the spool valves 404*a*-404*c* is fluidly coupled to the setting line 414. Additionally, each of the spool valves 404*a*-404*c* is configured to move to the closed or bypass position in response to a different amount of pressure. For example, each spool valve 404*a*, 404*b*, and 404*c* may be configured to use a bias element or spring having a different spring force or spring constant to oppose the pressure applied to the valve 404*a*, 404*b* and 404*c* by the setting line 414. As described below in more detail, the force applied by the bias element or spring of the example spool valve 404*a* determines the pressure that must be applied by the setting line 414 to move the spool valve 404*a* to the bypass position. In the illustrated example, all of the spool valves 404*a*-404*c* are fluidly coupled in parallel to the setting line 414 and, thus, may all respond to the setting line 414 pressure. While the example spool valves 404*a*-404*c* are described as using internal springs as bias elements to control the pressures at which the spool valves are moved to their bypass positions, any other type or combination of bias element(s) or member(s) may be used instead.

In the example of FIG. 4, the spool valve 404*a* has the lowest spring force or constant of the spool valves 404*a*-404*c*. Therefore, the spool valve 404*a* moves to a bypass position first as the fluid pressure in the setting line 414 increases. The example spool valve 404*b* has the next lowest spring force or constant and, thus, is the next to respond to the increasing setting line 414 pressure. Finally, the example spool valve 404*c* has the highest spring force or constant and, thus, is last to respond to increasing fluid pressure in the setting line 414

The number of sampling chamber 402*a*-402*c* that may be disposed in the downhole filtering and sampling apparatus 400 is dependent on the pressure that can be withstood by the materials and joints in the downhole filtering and sampling apparatus 400, as well as the precision with which the setting line 414 pressure may be controlled. As precision of control over the setting line 414 pressure increases, the springs forces or constants may be spaced closer together within the range of pressures that the downhole filtering and sampling apparatus 400 can withstand.

To bypass all of the sampling chambers 402*a*-402*c* and allow downhole fluid to flow between the seal valves 406 and 408 in either or both directions, the operator of the downhole filtering and sampling apparatus 400 may increase the pressure in the setting line 414 to burst a pressure disk 418. The example pressure disk 418 may withstand pressures greater than the highest pressure to move all spool valves 404*a*-404*c* to their bypass or closed positions. If the burst pressure of the pressure disk 418 is lower than the pressure to close any of the spool valves 404*a*-404*c*, the pressure disk 418 may burst before all of the spool valves 404*a*-404*c* move to their bypass or closed positions. Accordingly, the spool valves 404*a*-404*c* are all configured to be in a bypass position at a pressure which is lower than the burst pressure of the example pressure disk 418 and, when the pressure disk 418 is burst, the seal valves 406 and 408 are directly fluidly coupled via the setting line 414 and allow downhole fluid to flow in either or both directions.

The setting line 414 may also be used to bleed pressure from the sampling chambers 402*a*-402*c* via respective check valves 420*a*-420*c*. The check valves 420*a*-420*c* allow fluid to flow in only one direction (e.g., from the sampling chambers 402*a*-402*c* to the setting line 414). The check valves 420*a*-420*c* may be fluidly coupled to the respective sampling chambers 402*a*-402*c* such that any downhole fluid that exits via the check valves 420*a*-420*c* is filtered downhole fluid. As described below, the filters within the sampling chambers 402*a*-402*c* may filter a large amount of downhole fluid without clogging and, thus, a large amount of filtered downhole fluid may exit via the seal valve 408 and be directed to any other portion of a tool for storage or other uses.

The setting line 414 may further be used to bleed pressure from the final spool valve 404*c* via the transfer line 412*c* and a check valve 422. The check valve 422 allows fluid to flow from the spool valve 404*c* to the setting line 414. To bleed pressure, an operator of the downhole filtering and sampling apparatus 400 may reduce the pressure in the setting line 414 (e.g., via the pump out module 416) to a pressure less than that of the sampling chambers 402*a*-402*c* and/or the transfer line 412*c*. The appropriate check valve(s) 420*a*, 420*b*, 420*c*, and/or 422 will then allow fluid to flow from respective ones of the sampling chambers 402*a*-402*c* and/or the transfer line 412*c* to the setting line 414 and out the seal valve 408.

The example downhole filtering and sampling apparatus 400 may further include equalization lines 424*a* and 424*b*. The equalization line 424*a* fluidly couples the sampling chambers 402*a* and 402*b* to equalize the pressures of the sampling chambers 402*a* and 402*b* relative to each other. Similarly, the equalization line 424*b* fluidly couples the sampling chambers 402*b* and 402*c* to equalize the pressures of the sampling chambers 402*b* and 402*c* relative to each other. Thus, the equalization lines 424*a* and 424*b* maintain the pressures in the sampling chambers 402*a*-402*c* equal.

Figure 5:
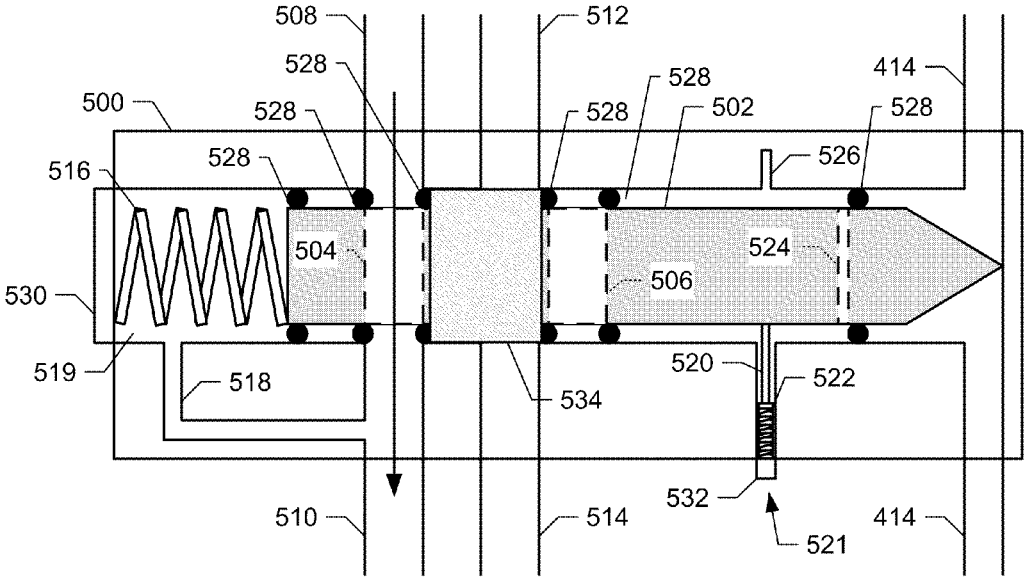
FIG. 5 is a schematic diagram of an example spool valve in an open, filtering or sampling position according to one or more aspects of the present disclosure.

FIG. 5 is a schematic diagram of an example spool valve 500 in a filtering, sampling or open position. The example spool valve 500 of FIG. 5 may be used to implement any one or more of the spool valves 402*a*-402*c* of FIG. 4. In the sampling position, the spool valve 500 allows fluid to flow into, for example, a sampling chamber such as the sampling chambers 402*a*-402*c* of FIG. 4. However, the example spool valve 500 may be used to route fluids to other downhole or surface locations in accordance with a particular application.

Figure 6:
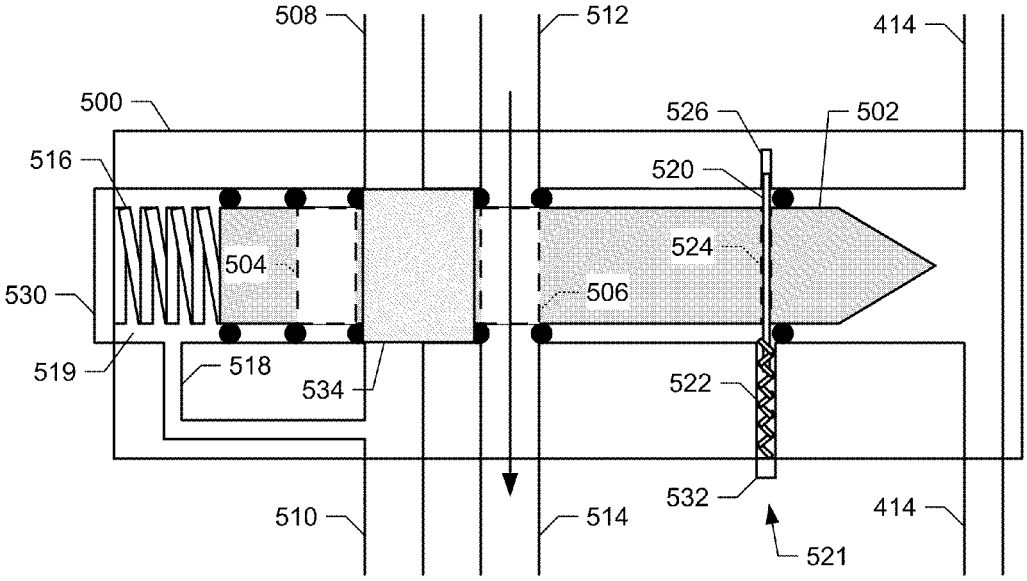
FIG. 6 is a schematic diagram of the example spool valve of FIG. 5 in a closed or bypass position according to one or more aspects of the present disclosure.

The example spool valve includes a fluid flow control member or piston 502 to move between the sampling position as illustrated in FIG. 5 and the bypass position as illustrated in FIG. 6. The piston 502 includes two fluid passages 504 and 506. Depending on the position (e.g., sampling or bypass) of the piston 502, one of the fluid passages 504 or 506 may allow fluid to flow through the body of the piston 502. The fluid passage 504 (e.g., a sampling fluid passage) selectively fluidly couples first ports 508 and 510 while the piston 502 is in the sampling position, and the fluid passage 506 (e.g., a bypass fluid passage) selectively fluidly couples second ports 512 and 514 while the piston 502 is in the bypass position. The example fluid passages 504 and 506 may be implemented using, for example, one or more holes through the piston 502. Alternatively, the piston 502 may have a reduced diameter to implement one or both of the flow passages 504 and 506 to allow fluid to flow around the piston 502. As illustrated in the example of FIG. 4, the ports 508 and 512 may be fluidly coupled. In some other applications, the example ports 510 and 514 may be fluidly coupled.

In the sampling position shown in FIG. 5, a bias member or spring 516 applies a force on the piston 502. The spring 516 applies the force or pressure on the piston 502 to oppose the hydraulic pressure or force applied on the piston 502 by fluid from the setting line 414 described above. An operator of the example downhole filtering and sampling apparatus 400 may control the pressure in the setting line 414. To retain the piston 502 in the sampling position, the force exerted by the setting line 414 must be less than or equal to (neglecting friction) the force applied by the spring 516. When the force applied by the hydraulic pressure in the setting line 414 is greater than the force applied by the spring 516, the example spool valve 500 moves to the bypass position as illustrated in FIG. 6 and described in more detail below.

The example spool valve further includes an escape line 518 that fluidly couples a chamber 519 surrounding the spring 516 to the port 510. The escape line allows the spring 516 to compress when surrounded by fluid. While the escape line 518 is shown as coupled to the port 510, the escape line 518 may be coupled to one or more of the other ports 508, 512, and/or 514, provided that fluid can flow from the chamber 519 surrounding the spring 516 through the escape line 518 to equalize pressure in the chambers (e.g., the chambers 402*a*-402*c* of FIG. 4).

To secure the example piston 502 when the bypass position has been achieved, the example spool valve 500 includes a locking pin 520 or, more generally, a lock 521. The example lock 521 further includes a locking spring 522 to push the locking pin 520 toward the piston 502. The piston 502 has a locking aperture or hole 524, and the spool valve 500 includes a locking slot 526 that receives the locking pin 520 when the bypass position is achieved. When the piston 502 is pushed toward the spring 516 due to fluid or hydraulic pressure from the setting line 414, the locking hole 524 passes over the locking pin 520 and locking slot 526, at which time the locking spring 522 pushes the locking pin 520 into the locking hole 524 and the locking slot 526. The final position of the locking pin 520, the locking spring 522, the locking hole 524 and the locking slot 526 are illustrated in FIG. 6. When the locking pin 520 has locked or fixed the piston 502 to the locking slot 526, the piston 502 will not move back to the sampling position until reset by an operator at the surface.

The example spool valve 502 further includes a plurality of seals 528 (e.g., o-rings). The seals 528 prevent undesired fluid communication between the ports 508-514 and/or the setting line 414.

To install the piston 502 and the spring 516, the example spool valve 500 may include a cap 530. Similarly, a cap 532 may be provided to install (and enable resetting of) the locking pin 520 and the locking spring 522. When assembling the spool valve 500, the example piston 502 is inserted. The spring 516 may then be inserted and compressed, and the cap 530 may then be installed to retain the spring 516 and the piston 502. When the piston 502 is installed, the locking pin 520 and locking spring 522 may be inserted. The cap 532 is then installed to retain the locking pin 520 and locking spring 522.

The example piston 502 is further provided with a glide ring 534 to allow the piston 502 to slide or move easily within the spool valve. The glide ring 534 may be used to block fluid flow to a port (e.g., the port 510 or 514) that is not considered open. For example, in FIG. 5 the glide ring 534 blocks or prevents fluid from flowing between the ports 512 and 514. In FIG. 6, the glide ring 534 blocks or prevents fluid from flowing between the ports 508 and 510. While the example glide ring 534 may not completely seal the port 508 from the port 510 or the port 512 from the port 514, the glide ring 534 may have a diameter sufficient to block most downhole fluid and/or particulate from flowing around the glide ring.

In the downhole filtering and sampling apparatus 400 of FIG. 4, the glide ring 534 may be used to block fluid flow because there is little or no pressure differential between the ports 508 and 510 and/or between the ports 512 and 514. However, in applications where there may be a pressure differential sufficient to cause fluid to flow around the glide ring 534, the example ports 508 and 512 may be laterally offset from the example ports 510 and 514, respectively. As a result, the seals 528 may prevent lateral fluid flow along the piston 502 and, thus, fluidly decouple the ports 508 and 512 from the respective ports 510 and 514 when the flow passages 504 and 506 do not fluidly couple the ports.

FIG. 6 is a schematic diagram of the example spool valve 500 of FIG. 5 in a bypass position. As described above, a user of the downhole filtering and sampling apparatus 400 may increase the pressure in the setting line 414 to a pressure that applies a force greater than the force applied by the spring 516 to move the piston 502 into the bypass position. As a result, the sampling fluid passage 504 moves out of fluid communication with the ports 508 and 510, and the bypass fluid passage 506 allows fluid to flow between the ports 512 and 514. In the example downhole filtering and sampling apparatus 400, the port 514 allows fluid to flow to another spool valve and/or to the setting line 414 in the case of the spool valve 404*c*.

As shown in FIG. 6, the example locking pin 520 locks or fixes the piston 502 relative to the locking slot 526. Thus, the locking pin 520 prevents the piston 502 from moving back to the sampling position even if the setting line 414 pressure decreases to apply less force than the force applied by the spring 516 and/or in response to shocks or vibrations that may occur in a downhole environment.

While the example spool valve 500 illustrated in FIGS. 5 and 6 has four ports 508-514 and two fluid passages 504 and 506, other port and fluid passage configurations may be used. For example, one fluid passage may be used to move from coupling ports 512 and 514 in a first position to coupling ports 508 and 510 in a second position.

Additionally, the locking pin 520, the locking spring 522, the locking hole 524, the locking slot 526 and/or, more generally, the lock 521 may be implemented using any locking mechanism or member to lock the piston 502 or prevent the piston 502 from moving from the bypass or closed position. Other locking or arresting mechanisms that may be used to implement the lock 521 include, but are not limited to, locking rings, locking clips, friction locks, electromechanical locks, electropneumatic locks, electromagnetic locks, or similar mechanisms.

Figure 7:
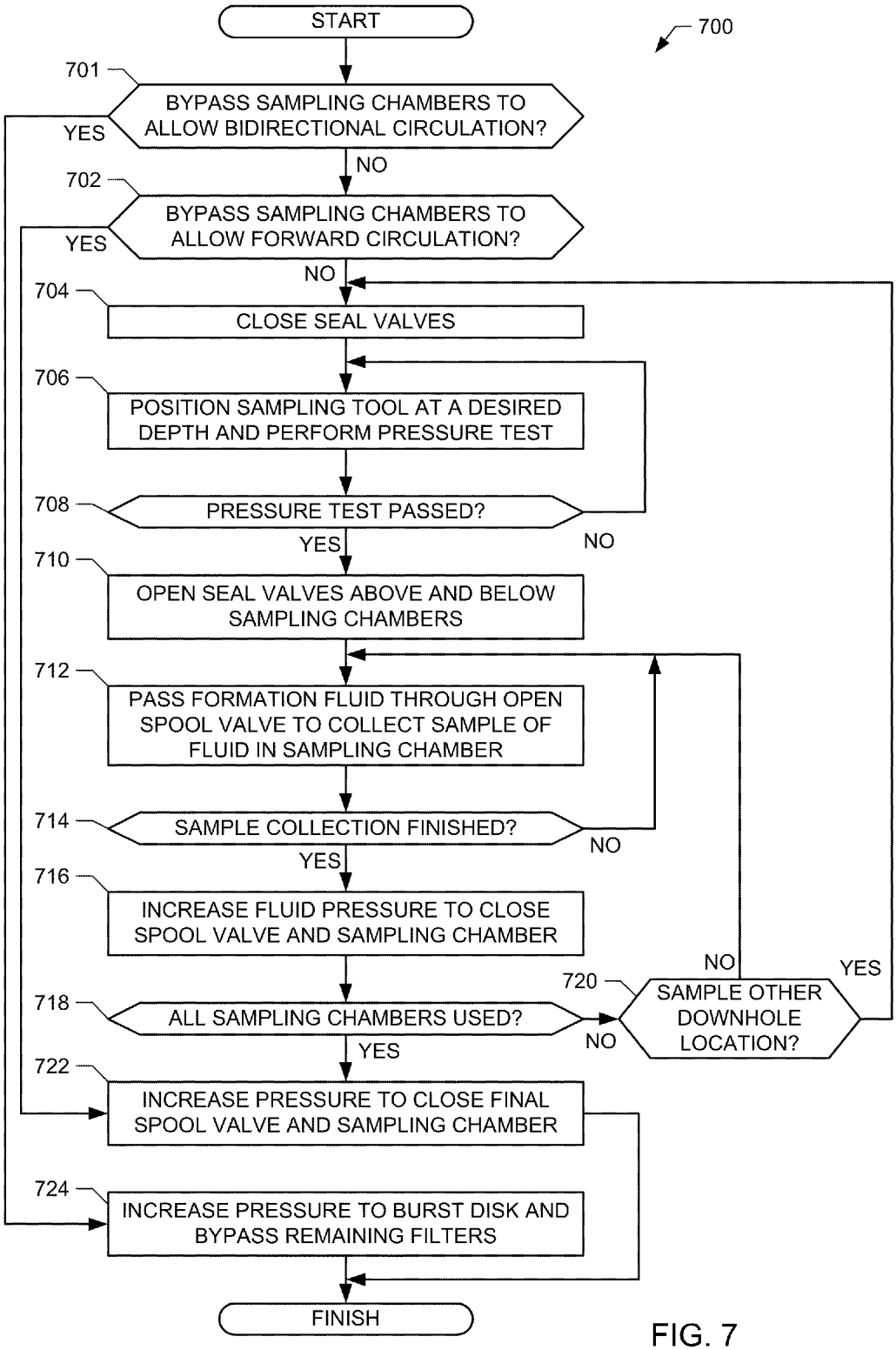
FIG. 7 is a flow diagram of an example process that may be used to implement an example filtering and sampling apparatus according to one or more aspects of the present disclosure.

FIG. 7 is a flow diagram of an example process 700 that may be used to operate the example filtering and sampling apparatus described herein. The example process 700 will be described in connection with the example wireline tool 300 of FIG. 3, the example downhole filtering and sampling apparatus 400 of FIG. 4 and the example spool valve 500 of FIGS. 5 and 6.

The example process 700 may begin with the wireline tool 300 disposed downhole and provided with the example downhole filtering and sampling apparatus 400. An operator of the downhole filtering and sampling apparatus 400 may determine whether to bypass one or more remaining sampling chambers 402*a*-402*c* to allow bidirectional fluid circulation (e.g., downhole fluid flow in either or both directions (i.e., bidirectional fluid circulation) between the seal valves 406 and 408) (block 701). If the operator does not want to allow bidirectional fluid circulation (block 701), the operator may determine whether to bypass one or more remaining sampling chambers 402*a*-402*c* while maintaining forward downhole fluid flow (e.g., from the seal valve 406 to the seal valve 408 via the remaining sampling chambers 402*a*-402*c*) (block 702). If the operator desires to collect samples using one or more remaining sampling chambers and, thus, to not bypass these chambers (block 702), the seal valves 406 and 408 are closed (block 704). The operator of the downhole filtering and sampling apparatus 400 positions the sampling tool (e.g., the wireline tool 300) at a desired downhole depth and performs a pressure test (block 706). If the wireline tool 300 determines that the pressure test fails (block 708), control will return to block 706 to reposition the wireline tool 300 and retest.

If the pressure test passes (block 708), the example seal valves 406 and 408 are opened above and below the sampling chambers 402*a*-402*c* (block 710). As a result of opening the seal valves 406 and 408, downhole fluid flows into an open sampling chamber (e.g., the chamber 402*a*) via the spool valve 404*a* (block 712). The downhole fluid is filtered in the sampling chamber 402*a* to collect one or more filtered samples of the downhole fluid in the sampling chamber 402*a*. The example process 700 determines whether the sample collection is finished (e.g., whether the sampling chamber 402*a* is full, or whether another condition is met) (block 714). If the sample collection is not finished (e.g., if the sampling chamber 402*a* is not full) (block 714), control loops to block 712 to continue sampling downhole fluid.

When the sample collection is finished (block 714), the example downhole filtering and sampling apparatus 400 increases the pressure in the setting line 414 to activate the spool valve 500 (e.g., the spool valve 404*a*) to move the spool valve 500 from the sampling position to the bypass position to close the sampling chamber 402*a* (block 716). In block 714, the pressure 414 should only increase enough to close the spool valve 404*a* above the now full sampling chamber 402*a*. If the pressure is increased too much, additional spool valves 404*b* and 404*c* may move to the bypass position prematurely, thereby preventing fluid from entering the corresponding sampling chambers 402*b* and 402*c*.

The example process 700 then determines whether all sampling chambers 402*a*-402*c* have been used (block 718). If all sampling chambers 402*a*-402*c* have not been used (block 718), the process 700 determines whether another downhole location is to be sampled (block 720). For example, the operator of the downhole filtering and sampling apparatus 400 may determine whether another downhole location is to be sampled. If the same location is to be sampled using another sampling chamber 402*b* (e.g., to filter the sample differently) (block 720), control returns to block 712 to pass downhole or formation fluid to another sampling chamber 402*b* via a corresponding spool valve 500 in the sampling position (e.g., the spool valve 404*b*). If a different location is to be sampled (block 720), control returns to block 704 to close the seal valves 406 and 408 in preparation to reposition the wireline tool 300. Although not illustrated in FIG. 7, the example downhole filtering and sampling apparatus 400 may also open and close the relief valve 410 to reduce pressure at the seal valve 406 and/or the setting line 414.

When all sampling chambers 402*a*-402*c* have been used (block 718), the setting line 414 increases fluid or hydraulic pressure to close the final sampling chamber 402*c* (block 722). Closing the sampling chamber 402*c* may include moving the spool valve 404*c* to a bypass or closed position.

If the operator of the example downhole filtering and sampling apparatus 400 determines that one or more sampling chambers 402*a*-402*c* should be bypassed and forward flow is desired (block 702), control passes to block 722 to increase the pressure in the setting line 414 to close any remaining sampling chambers. If the operator determines that one or more sampling chambers 402*a*-402*c* should be bypassed and bidirectional flow is desired (block 701), control passes to block 724 to increase the pressure in the setting line 414 to burst a disk (e.g., the disk 418) (block 724). When the disk 418 is burst, the seal valves 406 and 408 are fluidly coupled and downhole fluid may bypass the spool valves 404*a*-404*c* and the sampling chambers 402*a*-402*c*. After either block 722 or 724, the example process 700 may end.

The example method 700 and the example downhole filtering and sampling apparatus 400 may be used with the example MWD or LWD systems described with reference to FIG. 1. In such an example, the seal valve 406 is located at the surface (e.g., the annulus of the drill pipe) and the seal valve 408 is located at the annulus between the drill pipe and the casing.

Figure 8A:
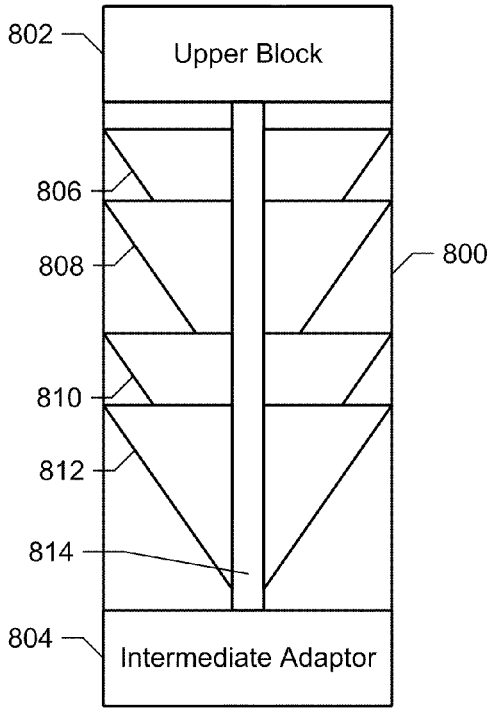
FIGS. 8A-8D are schematic diagrams illustrating example sampling chambers and associated connections according to one or more aspects of the present disclosure.

FIG. 8A is a schematic diagram illustrating an example sampling chamber 800 and associated connections. The example sampling chamber 800 is coupled to an upper block 802 and an example intermediate adaptor 804. The example sampling chamber 800 includes four cone-shaped filters 806, 808, 810, and 812, which are supported within the sampling chamber 800 by a mandrel 814. The example sampling chamber 800, the example filters 806-812, and the example mandrel 814 are described in more detail below.

The example upper block 802 is generally coupled to the first sampling chamber 800 (e.g., the sampling chamber 402*a* of FIG. 4) in the downhole filtering and sampling apparatus 400 of FIG. 4. The upper block 802 may couple the downhole filtering and sampling apparatus 400 to, for example, a sampling probe to receive downhole fluids from a formation. The example upper block 802 is shown and described in further detail below in connection with FIG. 9. The example intermediate adaptor 804 may couple two sampling chambers 800 (e.g., the sampling chambers 402*a* and 402*b*, or the sampling chambers 402*b* and 402*c*). The intermediate adaptor 804 is shown and described in further detail below in connection with FIG. 10.

The example mandrel 814, in addition to supporting the filters 806-812, may conduct electrical signals and/or fluids between the upper block 802 and the intermediate adaptor 804. The mandrel 814 is shown and described in more detail below in connection with FIGS. 9-12.

Figure 8B:
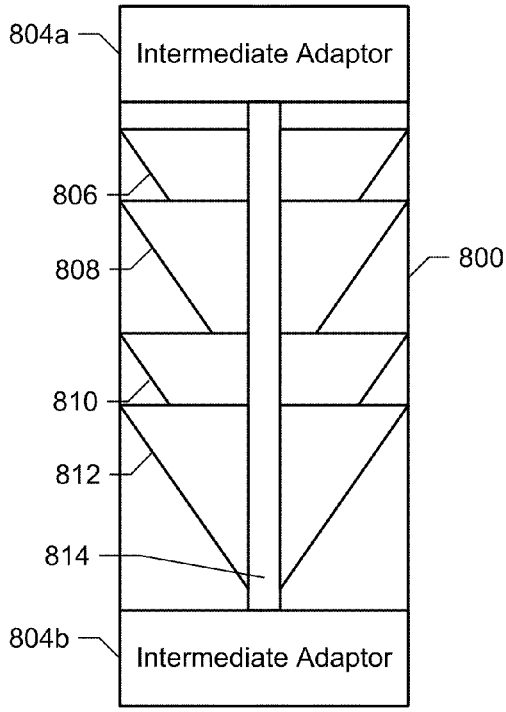

FIG. 8B is a schematic diagram illustrating an example sampling chamber 800 coupled between two intermediate adaptors 804*a* and 804*b*. The upper intermediate adaptor 804*a* may couple the sampling chamber 800 (e.g., the sampling chamber 402*b* of FIG. 4) to another sampling chamber (e.g., the sampling chamber 402*a*) that is filled before the sampling chamber 800 is filled. The lower intermediate adaptor 804*b* may couple the sampling chamber 800 to another sampling chamber (e.g., the sampling chamber 402*c*) that is filled after the sampling chamber 800 is filled.

Figure 8C:
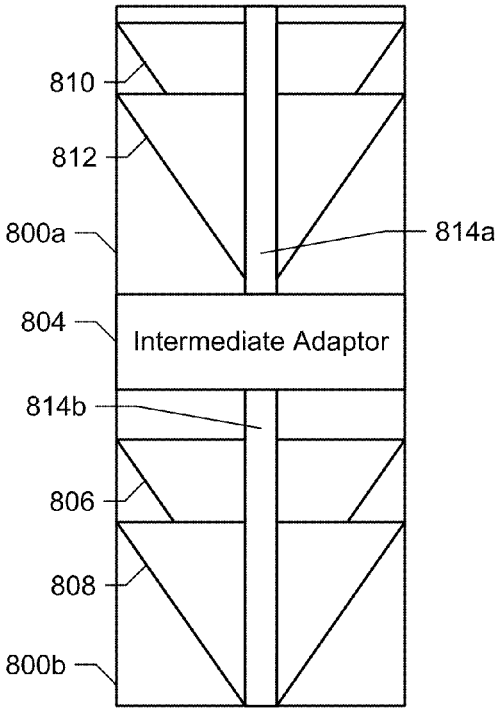

FIG. 8C is a schematic diagram illustrating an example intermediate adaptor 804 coupling a first sampling chamber 800*a* to a second sampling chamber 800*b*. The first sampling chamber 800*a* is shown with two filters 810 and 812, and the second sampling chamber 800*b* is shown with two filters 806 and 808. As described in more detail in connection with FIG. 10 below, the intermediate adaptor 804 may allow fluid to enter the sampling chamber 800*b* when the sampling chamber 800*a* has filled.

Figure 8D:
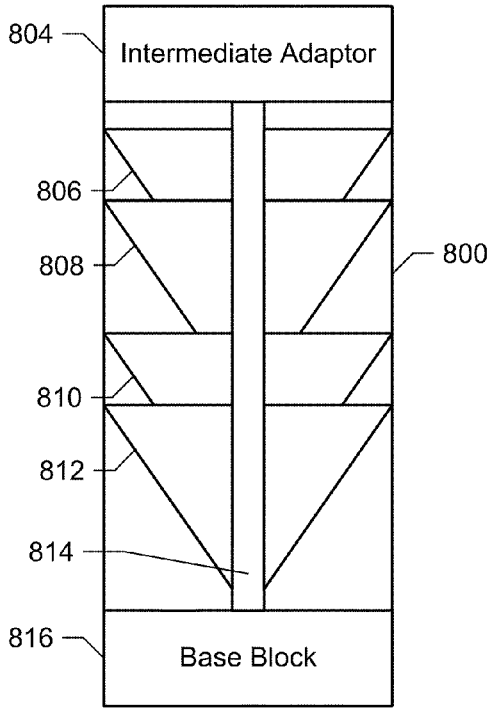

FIG. 8D is a schematic diagram illustrating an example sampling chamber 800 coupled to an intermediate adaptor 804 and a base block 816. The sampling chamber 800 (e.g., the sampling chamber 402*c*) may be coupled to another sampling chamber (e.g., the sampling chamber 402*b*) via the intermediate adaptor 804. Additionally or alternatively, the sampling chamber 800 may be coupled to another module or portion of the wireline tool 300 via the base block 816. In general, the base block 816 is coupled to the final sampling chamber 800 in order of filling. The example base block 816 is shown and described in more detail below in connection with FIG. 11.

Figure 9:
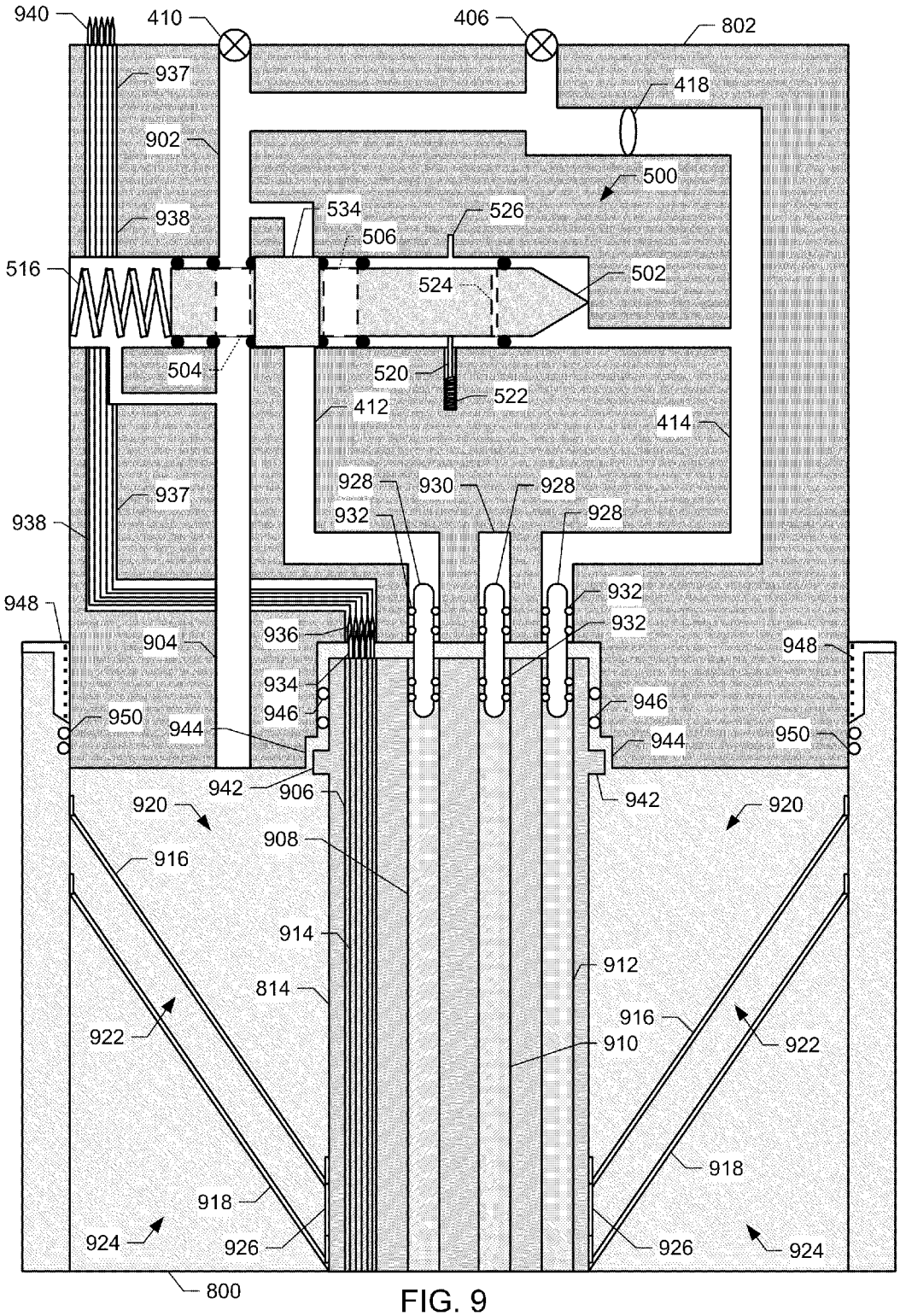
FIG. 9 is a schematic diagram of an example upper block mechanically, fluidly, and/or electrically coupled to a sampling chamber according to one or more aspects of the present disclosure.

FIG. 9 is a schematic diagram of an example upper block 802 mechanically, fluidly, and/or electrically coupled to a sampling chamber 800, which is only partially depicted in FIG. 9. The example upper block 802 includes the example spool valve 500 described in connection with FIGS. 5 and 6 to receive downhole fluids from a subterranean formation F, filter the downhole fluids, collect the downhole fluids in the sampling chamber 800, and redirect the fluids to another sampling chamber when the sampling chamber 800 is full. For the purposes of illustration, the sampling chamber 800 and the upper block 802 shown in FIG. 9 are not fully mechanically coupled.

As illustrated in FIG. 9, the example spool valve 500 is in the sampling position and therefore couples a flowline 902 to a sampling line 904 to allow fluid to flow from a seal valve 406 to the sampling chamber 800.

The example mandrel 814 illustrated in FIG. 9 includes four lines: an electric line 906, a transfer line 908, an equalizing line 910, and a setting line 912. The electric line 906 may act as a conduit for one or more conductors 914 to transmit electrical signals in either direction along the wireline tool 300 of FIG. 3.

The sampling chamber 800 may include one or more filters 916 and 918 to filter solids of different sizes from downhole fluids. For example, the sampling chamber 800 illustrated in FIG. 9 includes two cone-shaped filters 916 and 918. As described in further detail below, the filters 916 and 918 are cone-shaped to increase filtering volume and to prevent clogging of the filters 916 and 918. The filters 916 and 918 create three volumes 920, 922 and 924 in which sample fluid may be collected. The example filters 916 and 918 encircle the mandrel 814, which supports the filters 916 and 918. A spacer 926 may be disposed around the mandrel between the filters 916 to adjust the volume of the respective volumes 920, 922 and 924. For example, a larger spacer 926 will increase the volume 922 while decreasing the volumes 920 and/or 924.

The mandrel transfer line 908 and the mandrel setting line 912 are fluidly coupled to respective ones of the transfer line 412 and the setting line 414 via hollow stabbers 928. The mandrel equalizing line 910 is also coupled to an upper block equalizing line 930 via a stabber 928. The upper block equalizing line 930 is a dead end because the equalizing line 910 fluidly couples different sampling chambers and the upper block 802 is one end of a cascade of sampling chambers. To prevent fluid coupling of the upper block transfer line 412, the upper block setting line 414, the electrical line 906, the mandrel transfer line 908, the mandrel equalizing line 910, and/or the mandrel setting line 912 to the sampling chamber 800 (e.g., the volume 920), the stabbers 928 are encircled by one or more seals 932. The seals 932 also function to hold the stabbers 928 and the mandrel 814 in place.

The mandrel electric line 906 is coupled to an electric line 937 in the upper block 802 via one or more pins 934 corresponding to the conductors 914. The upper block 802 includes one or more receptors 936 to make contact with the pins 934, and also includes one or more conductors 938. The conductors 938 conduct one or more signals to upper block pins 940, which may conduct the signals to or from another downhole or surface location.

The example mandrel 814 is aligned by one or more keys 942, which fit into one or more corresponding recesses or slots 944 in the upper block 802. One or more seals 946 may fluidly decouple the sampling chamber 800 (e.g., the volume 920) from the lines 906-912 through the mandrel 814 and the lines 904, 412, and/or 414 in the upper block 802.

To mechanically couple the upper block 802 to the sampling chamber 800, the upper block 802 may include a threaded ring 948. The upper block 802 has corresponding threads to mechanically couple the upper block 802 to the sampling chamber 800 via the threaded ring 948. To prevent fluid coupling of the sampling chamber 800 to the outside of the example apparatus 400, the upper block 802 and/or the sampling chamber 800 further includes one or more seals 950.

The mandrel 814 is inserted into the sampling chamber 800 at a surface location. One or more cone-shaped filters 916 and 918 and one or more spacers 926 are then inserted into the sampling chamber 800 around the mandrel 814. Some example cone-shaped filters 916 and/or spacers 926 may include notches to slide over the keys 942. The filters 916 and 918 and the spacers 926 may be alternately inserted to space the filters 916 and 918. To prevent air or other gas from becoming trapped in the sampling chamber 800 and/or the mandrel 814 and compressed downhole, the example sampling chamber 800 and/or the example mandrel 814 may be filled with a fluid such as an oil or water prior to continuing assembly.

When the filters 916 and 918 and the spacers 926 are inserted into the sampling chamber 800, the upper block 802 is coupled to the sampling chamber 800 via the threaded ring 948 and the one or more seals 950. When the upper block 802 and sampling chamber 800 are mechanically coupled, the mandrel lines 906-912 become electrically and/or fluidly coupled to the respective upper block lines 412, 414, 930, and/or 938. For example, the electrical pins 934 on the mandrel 814 mate with the receptors 936 on the upper block 802. Additionally, the stabbers 928 and the seals 932 fluidly couple the mandrel transfer line 908 to the transfer line 412, the mandrel equalizing line 910 to the upper block equalizing line 930, and/or the mandrel setting line 912 to the setting line 414.

In operation, when the example sampling chamber 800 and the example upper block 802 are inserted downhole to filter and collect a fluid sample, the example spool valve 500 is in a sampling position as shown. In the sampling position, the seal valve 406 is opened to allow fluid to enter the flowline 902. A second seal valve (e.g., the seal valve 408 of FIG. 4, not shown in FIG. 9) is opened, allowing fluid to enter the setting line 414 via the mandrel setting line 912 and the stabber 928 coupling the setting lines 414 and 912. The setting line 414 at this time is at a low pressure to avoid causing the spool valve 500 to change operating positions.

Figure 10:
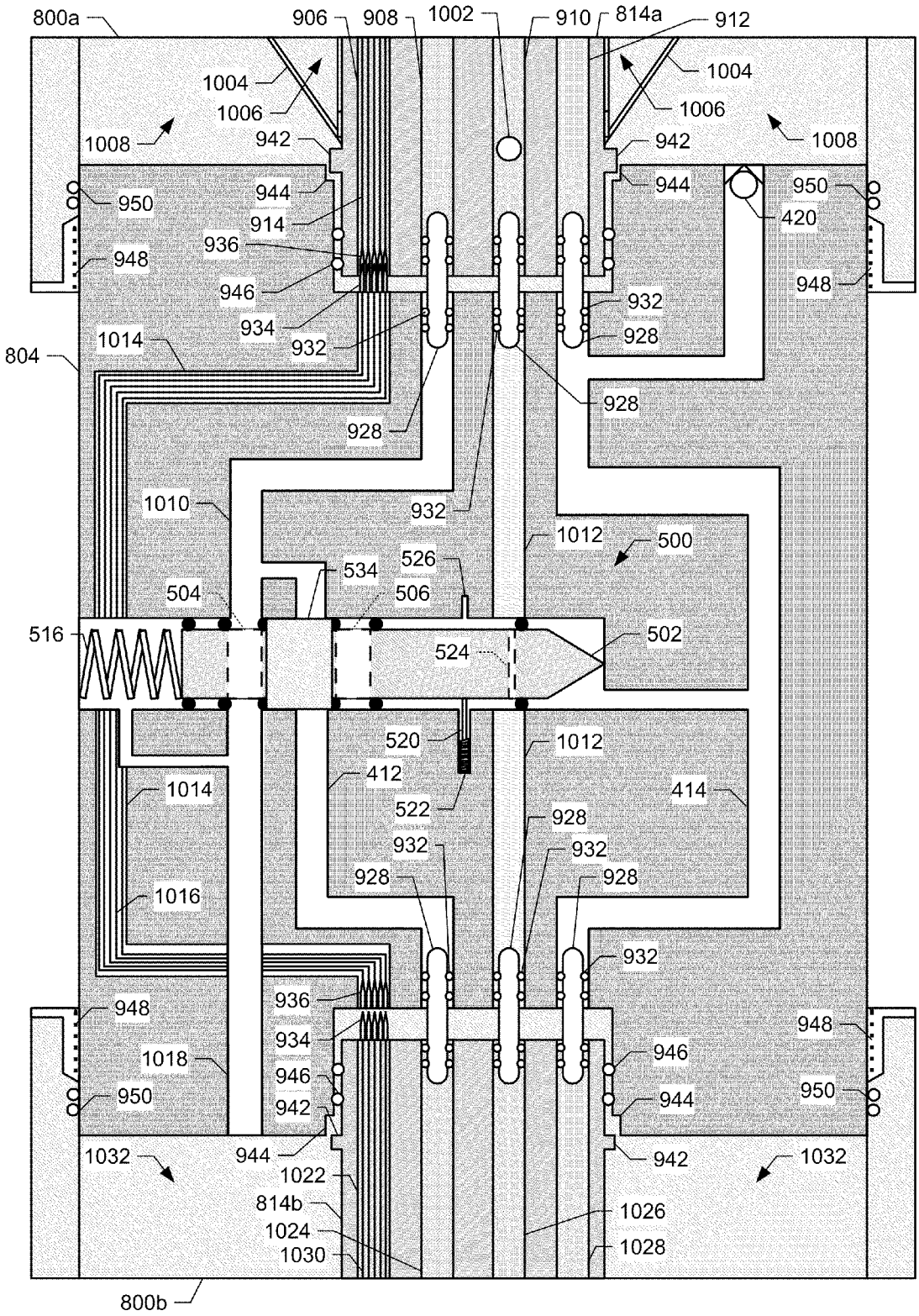
FIG. 10 is a schematic diagram of an example intermediate adaptor to mechanically, fluidly, and/or electrically coupling two sampling chambers according to one or more aspects of the present disclosure.

In the sampling position, the piston 502 allows fluid to flow from the flowline 902 to the sampling line 904 and into the sampling chamber 800 (e.g., the volume 920). In the sampling position, the piston 502 also blocks or prevents fluid from flowing from the flowline 902 to the transfer line 412. As downhole fluid enters the sampling chamber 800 from the sampling line 904, the downhole fluid displaces any fluid placed in the sampling chamber 800 at the surface. The displaced fluid may exit the sampling chamber 800 via the equalizing line 910 as shown in FIG. 10 and described below, and/or via the check valve 420 illustrated in FIGS. 4 and 10.

The downhole fluid enters the first volume 920 and is first filtered by the filter 916 to enter the second volume 922. The filter 916 is the coarsest of the filters 916 and 918 and retains the largest objects. Thus, the downhole fluid that enters the second volume 922 does not include objects as large as those that enter the volume 920. The downhole fluid then passes through the filter 918, which is finer than the example filter 916, to reach the third volume 924. The filter 918 removes smaller objects and/or particles from the downhole fluid than the filter 916. The downhole fluid in the volume 924 includes smaller particles than those in the volumes 922 and 920. When the sampling chamber 800 is retrieved at the surface, three different fluid samples may be retrieved from the different volumes 920-924. While only two filters 916 and 918 and three volumes 920-924 are illustrated in FIG. 9, additional filters may be included, thereby creating additional different sample volumes. In general, the downhole fluid passes through filters 916 and 918 from coarsest to finest, and the downhole fluid in the volumes 920-924 has progressively finer particulate.

When the sampling chamber 800 is filled with downhole fluid, or at the direction of an operator at the surface, the example upper block 802 may move the piston 502 to a bypass or closed position. To move the piston 502, the setting line 414 (e.g., via the mandrel setting line 912) increases fluid pressure relative to the flowline 902. The fluid pressure overcomes the force applied to the piston 502 via the spring 516 to push the piston 502 toward the spring 516. The spool valve 500 then enters the bypass position as illustrated in FIG. 6, and the example locking pin 520 locks the piston 502 in the bypass position.

When the piston 502 moves to the bypass position, the fluid passage 504 no longer allows fluid flow between the flowline 902 and the sampling line 904. Instead, the fluid passage 506 allows fluid to flow from the flowline 902 to the transfer line 412 and the mandrel transfer line 908. The fluid may then flow to, for example, an intermediate adaptor 804 as illustrated in FIG. 10.

As described in connection with FIG. 4, the pressure disk 418 may be burst to fluidly couple the seal valve 406 and the flowline 902 to the setting line 414. The relief valve 410 may also be provided to relieve pressure on the flowline 902 to, for example, allow a sampling probe to disengage a subterranean formation.

FIG. 10 is a schematic diagram of an example intermediate adaptor 804 to mechanically, fluidly, and/or electrically couple two sampling chambers 800*a* and 800*b*. In the example of FIG. 10, the sampling chamber 800*a* and mandrel 814*a* will be described as a continuation of the example sampling chamber 800 and mandrel 814 of FIG. 9, respectively. The sampling chamber 800*a* includes an example mandrel 814*a* and the example mandrel lines 906-912 described in connection with FIG. 9.

The example equalizing line 910 includes an equalizing port 1002 to fluidly couple the sampling chamber 800*a* to the equalizing line 910. Fluid may enter and/or exit the equalizing line 910 from the sampling chamber 800*a* via the equalizing port 1002. The sampling chamber 800*a* further includes a filter 1004 to filter downhole fluid. The filter 1004 separates volumes 1006 and 1008, and filters the fluid from the volume 1006 to remove particles in the downhole fluid. As a result, the example downhole fluid in the volume 1008 is the most-filtered downhole fluid in the sampling chamber 800*a*. In some applications, the filter 1004 may be sufficiently fine to remove sand or other very fine particulate matter from a downhole fluid sample.

To couple the mandrel 814*a* to the intermediate adaptor 804, the example sampling chamber 800*a* includes a threaded ring 948 similar to the threaded ring 948 illustrated in FIG. 9. The example mandrel 814*a* and/or the intermediate adaptor 804 may also include one or more seals 950 similar to the seals 950 illustrated in FIG. 9. The example intermediate adaptor 804 includes a flowline 1010 fluidly coupled to the mandrel transfer line 908 via a stabber 928. The flowline 1010 receives downhole fluid from the mandrel transfer line 908 when a spool valve 500 (e.g., the example spool valve 500 illustrated in FIG. 9) in an upper block 802 or intermediate adaptor 804 above the intermediate adaptor 804 illustrated in FIG. 10 moves to a bypass position. The intermediate adaptor 804 includes an equalizing line 1012 to equalize fluid pressures between the sampling chambers 800*a* and 800*b* and/or additional sampling chambers. The equalizing line 1012 is coupled to the mandrel equalizing line 910 via a stabber 928.

The intermediate adaptor 804 further includes a transfer line 412, a setting line 414, and an electrical line 1014. The example electrical line 1014 includes one or more conductors 1016 to transfer electrical signals and/or power along the wireline tool 300. The conductors 1016 are terminated at respective pins 934. The pins 934 are mated to receptors 936 at the mandrel electrical line 906 when the sampling chamber 800*a* is mechanically coupled to the intermediate adaptor 804.

Figure 11:
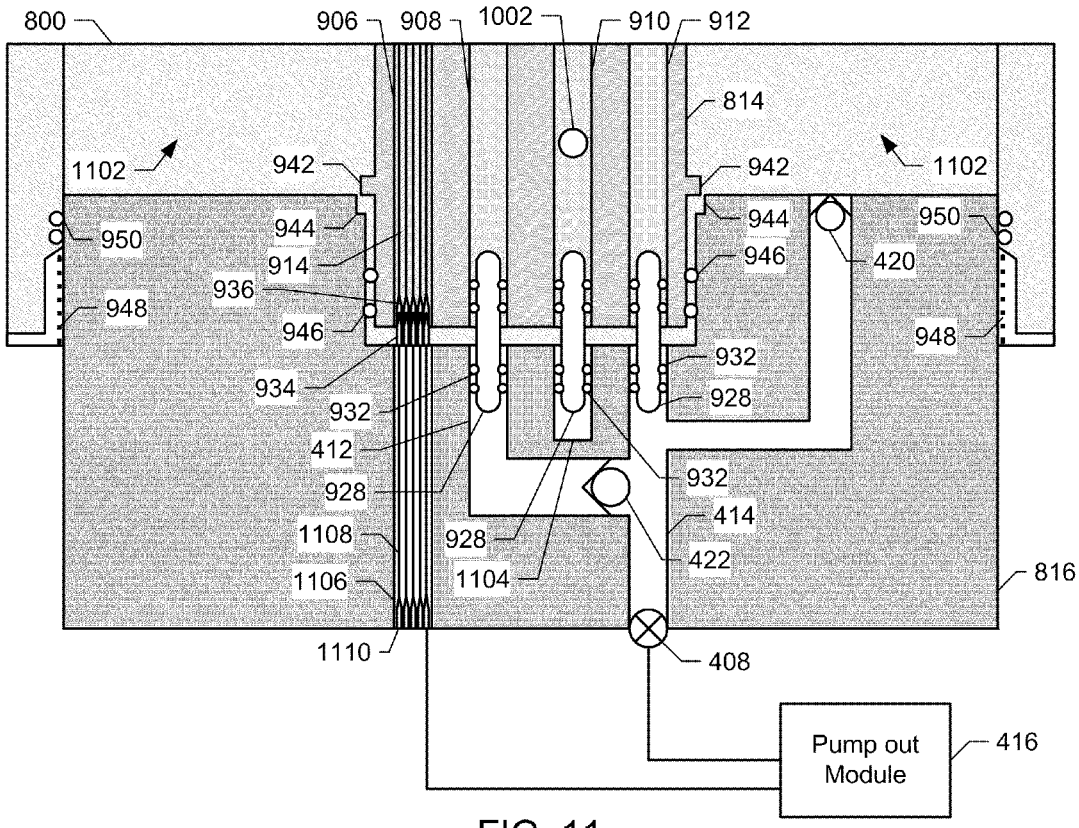
FIG. 11 is a schematic diagram of an example base block mechanically, fluidly, and/or electrically coupled to a sampling chamber according to one or more aspects of the present disclosure.

The transfer line 412 is coupled to the mandrel transfer line 908 via a stabber 928, and performs in substantially the same manner as the example transfer line 412 described in connection with FIG. 9 to fluidly couple the flowline 1010 to another spool valve, sampling chamber, and/or a base block 816 as illustrated in FIG. 11.

The example setting line 414 is coupled to the mandrel setting line 912 via a stabber 928. Additionally, the setting line 414 is coupled to the sampling chamber 800*a* (e.g., the volume 1008) via a check valve 420. The check valve 420 allows fluid to flow from the sampling chamber 800 to the setting line 414. For example, the check valve 420 may bleed pressure from the sampling chamber 800 and/or may allow fluid used to fill the sampling chamber 800*a* at the surface to escape as the filling fluid in the sampling chamber 800*a* is displaced with downhole fluid.

The spool valve 500 is set to a sampling position at a surface location. While in the sampling position, the spool valve 500 (e.g., via the fluid passage 504) fluidly couples the flowline 1010 to a sampling line 1018. The sampling line 1018 is also fluidly coupled to the sampling chamber 800*b* to allow downhole fluid to flow into the sampling chamber 800*b* for filtering and/or sampling.

The example intermediate adaptor 804 is further mechanically coupled to the sampling chamber 800*b* via a threaded ring 948 and one or more seals 950. A second mandrel 814*b* includes an electrical line 1022, a transfer line 1024, an equalizing line 1026, and a setting line 1028. The example electrical line 1022 includes one or more conductors 1030 to transmit electrical signals and/or power along the wireline tool 300. The conductors 1030 may be electrically coupled to corresponding conductors 1016 in the intermediate adaptor 804 electrical line 1014.

The example mandrel transfer line 1024 is coupled to the transfer line 412 via a stabber 928 and may allow downhole fluid to flow from the transfer line 412 when the spool valve 500 is in the bypass position. The transfer line 1024 may also be fluidly coupled to, for example, another intermediate adaptor 804 or a base block 816 as described below in connection with FIG. 11.

The equalizing line 1026 is coupled to the equalizing line 1012 via a stabber 928. The equalizing line 1026 may allow fluid to flow to equalize fluid pressures between the sampling chambers 800*a* and 800*b*.

The setting line 1028 is fluidly coupled to the setting line 414 via a stabber 928. The setting line 1028 may allow fluid to flow, for example, to move the piston 502 to the bypass position, to bleed pressure from the sampling chamber 800*a*, and/or to provide fluid to another intermediate adaptor 804 and/or an upper block 802.

The example mandrels 814*a* and 814*b* may be aligned by one or more keys 942, which fit into one or more corresponding slots or recesses 944 in the intermediate adaptor 804. One or more seals 946 may fluidly decouple the sampling chamber 800*a* from the lines 906-912 through the mandrel 814*a* and the lines 1010, 1212, and/or 414 in the intermediate adaptor 804. Additionally or alternatively, one or more seals 946 may fluidly decouple the sampling chamber 800*b* from the lines 1022-1028 through the mandrel 814*b* and the lines 1012, 412, and/or 414 in the intermediate adaptor 804.

While the illustrated portion of the sampling chamber 800*b* does not show filters, one or more filters may be inserted into the sampling chamber 800*b* to filter downhole fluid and to separate different volumes. An example volume 1032 is illustrated in FIG. 10. The sampling chamber 800*b* may be filled with a fluid such as an oil, water, and/or another filling fluid to prevent gas from becoming trapped in the sampling chamber, compressing downhole, and/or contaminating the collected downhole fluid samples.

FIG. 11 is a schematic diagram of an example base block 816 mechanically, fluidly, and/or electrically coupled to a sampling chamber 800. Generally, the example base block 816 may be used at the end of one or more sampling chambers 800 to couple a downhole filtering and sampling apparatus 400 to another portion of a wireline tool 300. In the example of FIG. 11, the sampling chamber 800 and mandrel 814 will be described as a continuation of the example sampling chamber 800 and mandrel 814 of FIG. 9. However, the sampling chamber 800 and the mandrel 814 may also be used as a continuation of the example sampling chamber 800*b* and mandrel 814*b* of FIG. 10.

The example mandrel 814 includes the example electrical line 906, the example transfer line 908, the example equalizing line 910, and the example setting line 912 described in connection with FIG. 9. The equalizing line 910 is fluidly coupled to the sampling chamber 800 via an equalizing port 1002 as described above in connection with FIG. 10. Additionally, the example sampling chamber 800 includes one or more volumes 1102 that may be used to collect one or more downhole fluid samples. As illustrated in FIG. 9, one or more filters may be included in the sampling chamber 800 to filter downhole fluid and provide multiple volumes 1102 within the sampling chamber 800.

The example base block 816 includes a transfer line 412 fluidly coupled to the mandrel transfer line 908 via a stabber 928. The example transfer line 412 may transfer fluid from the mandrel transfer line 908 to the setting line 414. When an upper block (e.g., the upper block 802 of FIG. 9) and/or an intermediate adaptor (e.g., the intermediate adaptor 804 of FIG. 10) move a spool valve 500 to a bypass position, downhole fluid flows through the mandrel transfer line 908 to the transfer line 412. A check valve 422 allows fluid to flow from the transfer line 412 to the setting line 414.

The setting line 414 is fluidly coupled to the mandrel setting line 912 via a stabber 928. The setting line 414 is further fluidly coupled to the seal valve 408, which may open and close to increase and/or decrease fluid pressure in the setting line 414 via the pump-out module 416. The pump-out module 416 may receive electrical signals and/or power from, for example, the electrical line 1106. A check valve 420 may be used to bleed pressure from the sampling chamber 800 to the setting line 414.

The example base block 816 further includes an equalizing line 1104 fluidly coupled to the mandrel equalizing line 1104 via a stabber 928. The example equalizing line 1104 is a dead-end chamber to cause the sampling chamber 800 to equalize fluid pressure with other sampling chambers 800.

The base block 816 further includes an electrical line 1106. The example electrical line 1106 includes one or more conductors 1108 to transfer electrical signals and/or power along the wireline tool 300. The conductors 1108 may be electrically coupled to the mandrel electrical line 906 via one or more pins 934, which are mated to corresponding receptors 936 on the mandrel 814. The base block 816 includes one or more receptors 1110 to electrically couple the conductors 1108 to an external device on the wireline tool 300.

The base block 816 may be mechanically coupled to the sampling chamber 800 via a threaded ring 948 and one or more seals 950. The example mandrel 814 is aligned by one or more keys 942, which fit into one or more corresponding slots or recesses 944 in the base block 816. One or more seals 946 may fluidly decouple the sampling chamber 800 from the lines 906-912 of the mandrel 814 and the lines 1104, 412, and/or 414 in the base block 804. Seals 932 may also be used to fluidly decouple the lines 906-912 of the mandrel 814 and the lines 1104, 412, and/or 414 from the sampling chamber 800 and/or from each other.

Figure 12:
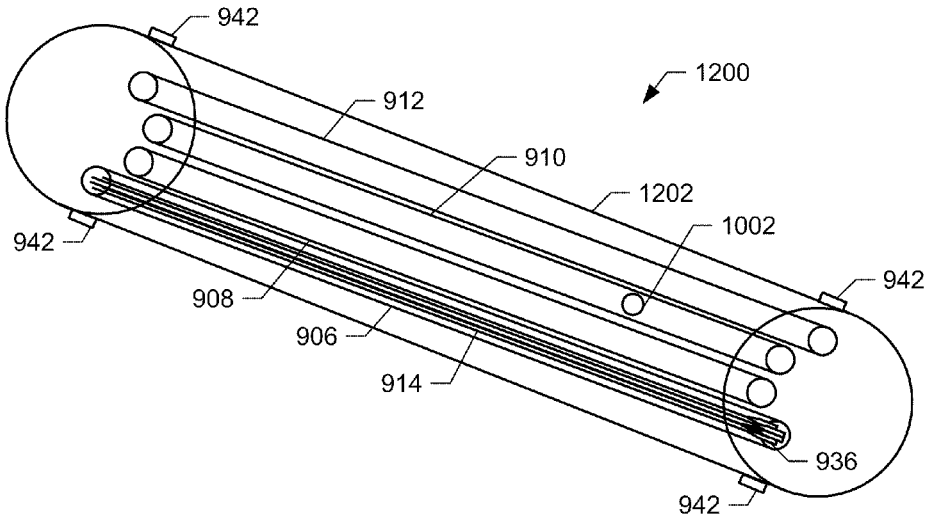
FIG. 12 is a diagram of an example mandrel according to one or more aspects of the present disclosure.

FIG. 12 is a diagram of an example mandrel 1200. The mandrel 1200 may be used to implement, for example, the mandrel 814 described in connection with FIG. 9. The example mandrel 1200 includes the electrical line 906, the transfer line 908, the equalizing line 910, and the setting line 912. The equalizing line 910 includes an equalizing port 1002 that is fluidly coupled to an outer housing 1202 of the mandrel 1200.

The example electrical line 906 includes the receptors 936 to receive corresponding pins (e.g., the pins 934 of FIG. 9). The receptors 936 are electrically coupled to the conductors 914, which are in turn coupled to pins (not shown) opposite the receptors 936.

The keys 942 may be coupled to the outer housing 1200 to guide a mechanical coupling of the mandrel 1200 to an upper block (e.g., the upper block 802 of FIG. 9), an intermediate adaptor (e.g., the intermediate adaptor 804 of FIG. 10), and/or a base block (e.g., the base block 816 of FIG. 11).

Figure 13:
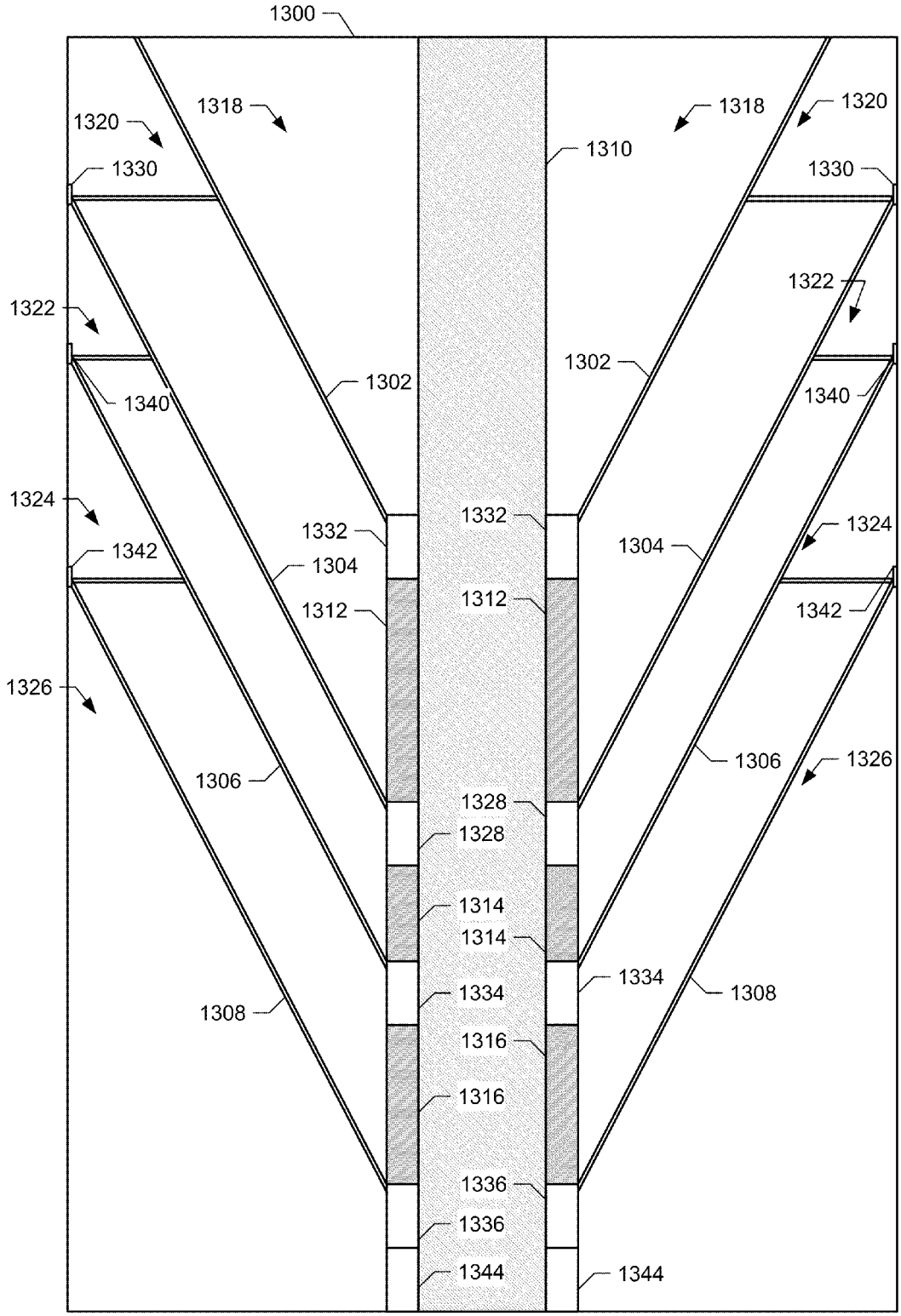
FIG. 13 is a diagram of an example sampling chamber and cone-shaped filters according to one or more aspects of the present disclosure.
Figure 14A:
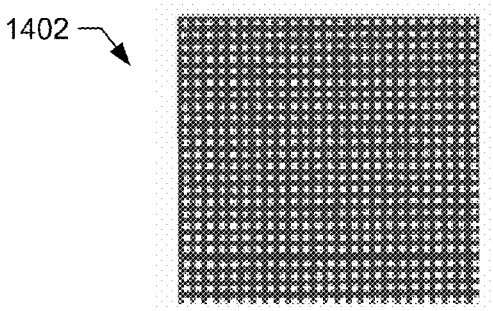
FIGS. 14A-14D illustrate some example filter screen patterns according to one or more aspects of the present disclosure.
Figure 14B:
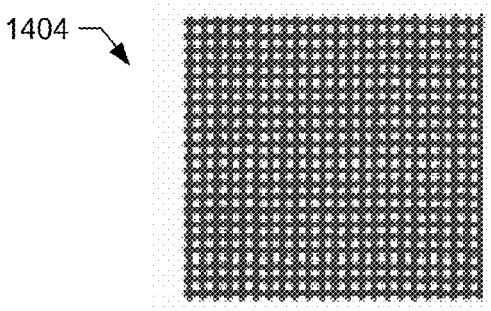
Figure 14C:
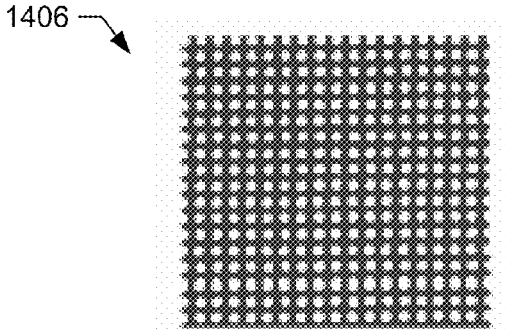
Figure 14D:
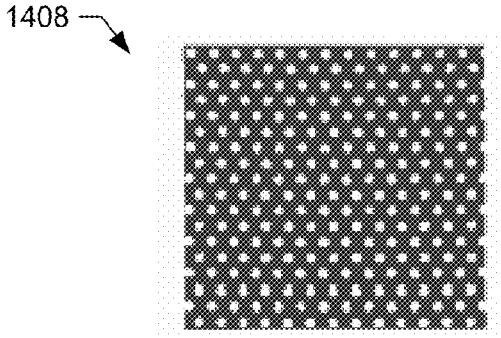

FIG. 13 is a diagram of an example sampling chamber 1300 and several cone-shaped filters 1302, 1304, 1306, and 1308. The example sampling chamber 1300 may be used to implement the example sampling chambers 402*a*-402*c* and/or 800 of FIGS. 4 and/or 8.

The example cone-shaped filters 1302-1308 may be used to filter objects from a downhole fluid sample collected from a subterranean formation. In the example of FIG. 13, downhole fluid is filtered first by the filter 1302, and the cone-shaped filters 1302-1308 screen progressively finer objects and/or particles as the downhole fluid sample progresses through the filters 1302-1308. Thus, the filter 1308 screens the finest matter from the downhole fluid.

The cone-shaped filters 1302-1308 are inserted into the sampling chamber 1300 around a mandrel 1310. The mandrel 1310 provides support to the filters 1302-1308 to maintain the filters in position. The filters 1302-1308 are separated by spacers 1312, 1314, and 1316. The spacers 1312-1316 are inserted over the mandrel alternately with the filters 1302-1308, and may be different lengths to adjust the amounts of space between the filters 1302-1308. The example sampling chamber 1300 is divided into volumes 1318, 1320, 1322, 1324, and 1326 by the filters 1302-1308. Therefore, as the spacers 1312-1316 increase in length, respective ones of the volumes 1318-1326 increase. In the illustrated example, the length of the spacer 1312 affects the size of the volume 1320.

The volumes 1318-1326 collect downhole fluid samples that may be retrieved at the surface. Because each filter 1302-1308 screens different sizes of matter or particulate from the downhole fluid, the volumes 1318-1326 may have different properties of fluid samples due to the different sizes of matter contained within.

The filter 1304 includes an inside ring 1328 and an outside ring 1330 to prevent downhole fluid from bypassing the filter 1302. The inside and outside rings 1328 and 1330 may seal along the outside of the sampling chamber 1300 and along the mandrel, respectively. The filters 1302, 1306, and 1308 include similar or identical inside rings 1332, 1334, and 1336, respectively, and/or similar or identical outside rings 1340 and 1342. The outside ring of the example filter 1302 is not shown. The rings 1328-1342 help maintain integrity of different downhole fluid samples in the different volumes 1318-1326. An additional ring 1344 around the mandrel 1310 may help seal the sampling chamber 1300 (e.g., the volume 1326) and determine the size of the volume 1326.

The example cone-shaped filters 1302-1308 may be manufactured using any of several methods. A first method that may be used is to machine a cone from a solid metal bar and perforate the outside with the desired screen pattern. A second method that may be used is to bend one or more perforated metal sheets into a cone shape. FIGS. 14A-14D illustrate some example screen patterns 1402, 1404, 1406, and 1408. These screen patterns may be machined from a solid bar or may be perforation patterns on a metal sheet. The screen patterns 1402-1408 are examples only, and any desired screen pattern may be used depending on the particulate(s) to be removed from the downhole fluid.

Figure 15:
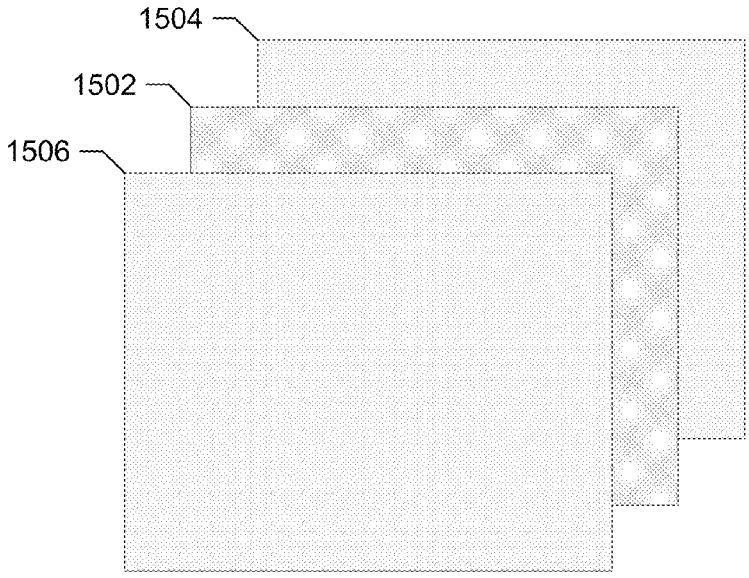
FIG. 15 illustrates an example downhole filter arrangement supported by perforated metal sheets according to one or more aspects of the present disclosure.

A third method that may be used to form a cone filter is placing a very fine filter, such as a filter made of fabric, between two or more metal screens. In general, the very fine filters may be subject to tearing or other breach. Therefore, the filter may be strengthened by placing the filter between two cone-shaped metal sheets that are perforated in a pattern such as those illustrated in FIG. 14. FIG. 15 illustrates an example downhole filter 1502 arrangement supported by perforated metal sheets 1504 and 1506. The example filter 1502 and metal sheets 1504 and 1506 may be formed into a cone shape for use in the example sampling chambers described herein.

Figure 16:
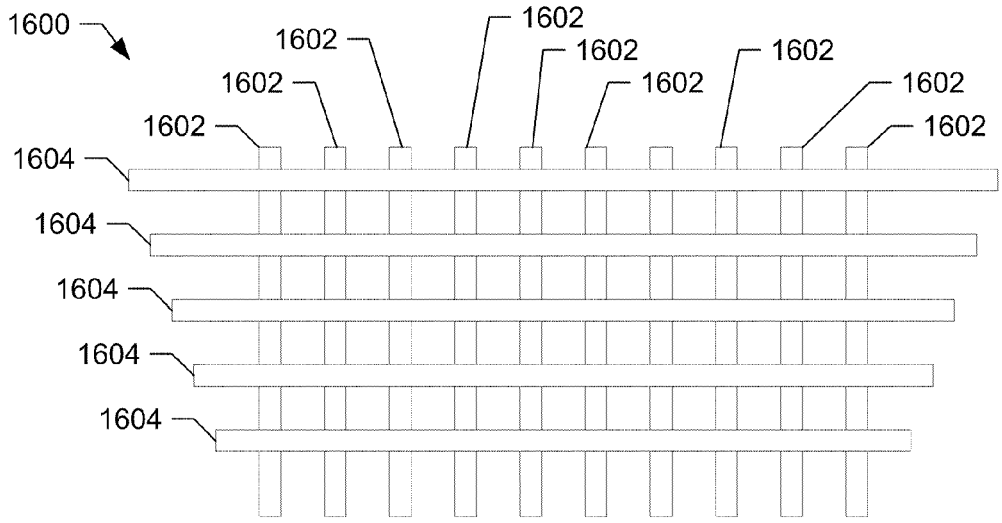
FIG. 16 illustrates an example wire pattern according to one or more aspects of the present disclosure.

A fourth method that may be used is to mechanically couple (e.g., solder, weld, etc.) a wire frame into a cone shape, and then couple wires around the frame. The spacing between the wires may determine the screen size. FIG. 16 illustrates an example wire pattern 1600 laid flat for viewing. The example wire pattern 1600 includes several longitudinal wires 1602 and several latitudinal wires 1604. The example longitudinal wires 1602 are formed into a cone shape. Therefore, the longitudinal wires 1602 have substantially the same lengths and may be substantially equally spaced. The example latitudinal wires 1604 wrap around the longitudinal wires 1602 on the inside and/or the outside of the cone shape. Thus, the latitudinal wires 1604 are longer around the wide end of the cone and shorter around the narrow end of the cone. The spacing between the longitudinal wires 1602 and the latitudinal wires 1604 determines the sizes of objects and/or particulate(s) that may be screened from a downhole fluid.

Figure 17:
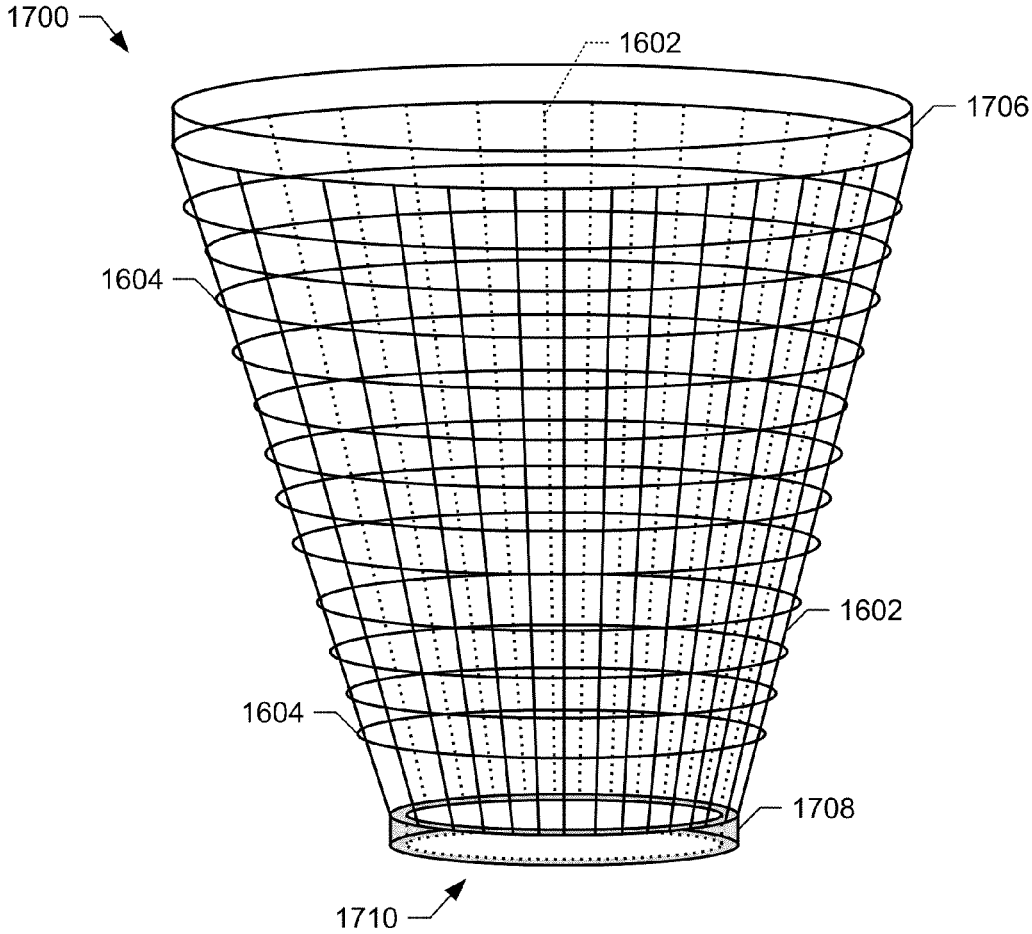
FIG. 17 illustrates an example cone-shaped filter using the wire method illustrated in FIG. 16 according to one or more aspects of the present disclosure.

FIG. 17 illustrates an example cone-shaped filter 1700 using the wire method illustrated in FIG. 16. The cone-shaped filter 1700 includes longitudinal wires 1602 that form a cone shape and latitudinal wires 1604 that wrap around the outside of the longitudinal wires 1602. In combination, the example longitudinal wires 1602 and latitudinal wires 1604 are fastened to form a screen. As mentioned above with reference to FIG. 13, the example cone-shaped filter 1700 includes seals 1706 and 1708 around the top and bottom of the cone-shaped filter 1700, respectively, to prevent downhole fluid from bypassing the cone-shaped filter 1700. The example cone-shaped filter 1700 further includes a space 1710 through which the mandrel may be inserted (or which may be inserted around a mandrel). Although three methods are described herein, other methods to manufacture the filter cones may be used.

In view of the above and the figures, it should be clear that the present disclosure introduces a system to filter and sample downhole fluids, which includes a first sampling chamber having one or more cone-shaped filters to receive downhole fluid, filter the downhole fluid, and store the downhole fluid, a second sampling chamber, a spool valve having first and second positions to allow the downhole fluid to flow into the first sampling chamber in the first position and to redirect the downhole fluid to the second sampling chamber or a base block in the second position, and a setting line to selectively move the spool valve from the first position to the second position.

The present disclosure also introduces a method to filter and sample downhole fluids, which includes setting a first valve to a first position to allow downhole fluid to flow into a first sampling chamber, filtering the downhole fluid via one or more filters in the first sampling chamber, collecting the downhole fluid in the first sampling chamber, and applying a first pressure to the first valve to set the first valve to a second position to allow fluid to flow into a second sampling chamber.

The present disclosure also introduces a spool valve to route downhole fluid, including a first port, a second port, a third port, and a flow control member, which includes a first flow passage to selectively fluidly couple the first port to the second port when the flow control member is in a first position, a second flow passage to selectively fluidly couple the first port to the third port when the flow control member is in a second position. The spool valve further includes a bias member to exert a force on the flow control member to urge the flow control member toward the first position, a pressure port to apply a pressure to move the flow control member from the first position to the second position, and a lock to prevent the flow control member from moving to the first position after the flow control member has achieved the second position.

The present disclosure also introduces a filter that includes a first plurality of wires to form a cone, a second plurality of wires mechanically coupled to the longitudinal wires to form a wire mesh, a first seal coupled to the first wires at a first end of the cone to prevent a downhole fluid from bypassing the filter, and a second seal coupled to the first wires at a second end of the cone to prevent the downhole fluid from bypassing the filter.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A spool valve system to route downhole fluid, comprising:

a first port and a fourth port configured to fluidly connect to a flowline, a second port and a third port;

a flow control member comprising a first flow passage to selectively fluidly couple the first port to the second port when the flow control member is in a first position, a second flow passage to selectively fluidly couple the fourth port to the third port when the flow control member is in a second position;

a bias member to exert a force on the flow control member to urge the flow control member toward the first position;

a pressure port to apply a pressure to move the flow control member from the first position to the second position; and a lock to prevent the flow control member from moving to the first position after the flow control member has achieved the second position.

2. The spool valve system of claim 1 wherein the flow control member is initially in the first position, wherein the second port is to be coupled to a sampling chamber, wherein the third port is to be coupled to a second spool valve, and wherein the lock comprises a locking spring and a locking slot to cause the locking pin to lock the flow controller in the second position.

3. The spool valve system of claim 2, wherein the sampling chamber comprises a plurality of volumes separated by one or more filters, and wherein the plurality of volumes are to store downhole fluid samples having different sizes of particulate matter.

4. The spool valve system of claim 2, wherein the sampling chamber comprises a mandrel to support one or more filters.

5. A method to filter and sample downhole fluids, comprising:

setting a first valve to a first position to allow downhole fluid to flow into a first sampling chamber;

filtering the downhole fluid via one or more filters in the first sampling chamber, wherein filtering the downhole fluid comprises passing the downhole fluid through a plurality of filters to remove progressively smaller objects from the downhole fluid;

collecting the downhole fluid in the first sampling chamber; and applying a first pressure to the first valve to set the first valve to a second position to allow fluid to flow into a second sampling chamber.

6. The method of claim 5 wherein the downhole fluid flows into the second sampling chamber via a second valve.

7. The method of claim 6 further comprising increasing the pressure on the second valve to change a position of the second valve.

8. The method of claim 7 wherein the pressure to set the second valve to the changed position is higher than the pressure to set the first valve to the second position.

9. The method of claim 6 further comprising applying a second pressure to close the first valve and the second valve and to burst a pressure disk.

10. The method of claim 5 wherein filtered downhole fluid flows out of the first or second sampling chamber via a check valve.

11. The method of claim 5 wherein applying the first pressure is in response to the downhole fluid substantially filling the first sampling chamber.

12. A system to filter and sample downhole fluids, comprising:

a sampling chamber comprising one or more filters to receive downhole fluid, filter the downhole fluid, and store the downhole fluid, wherein the sampling chamber comprises a plurality of volumes separated by the one or more filters and wherein the plurality of volumes are to store downhole fluid samples having different sizes of particulate matter;

a valve having first and second positions to allow the downhole fluid to flow into the sampling chamber in the first position and to bypass the sampling chamber in the second position; and a setting line to selectively move the valve from the first position to the second position.

13. The system of claim 12 wherein the one or more filters are one or more cone-shaped filters.

14. The system of claim 12 wherein the sampling chamber is a first sampling chamber and the system further comprises a second sampling chamber, and wherein the second position of the valve redirects the downhole fluid to the sampling chamber.

15. The system of claim 14 wherein the valve is a spool valve comprising:

a first port and a fourth port fluidly coupled to a flowline for the downhole fluid, a second port fluidly coupled to the first sampling chamber, and a third port fluidly coupled to the second sampling chamber or a base block;

a flow control member comprising a first flow passage to selectively fluidly couple the first port to the second port when the flow control member is in a first position, and a second flow passage to selectively fluidly couple the fourth port to the third port when the flow control member is in a second position;

a bias member to exert a force on the flow control member to urge the flow control member toward the first position;

a lock to prevent the flow control member from moving to the first position after the flow controller has achieved the second position; and a pressure port fluidly coupled to the setting line to apply a fluid pressure to move the flow control member from the first position to the second position.

16. The system of claim 15 further comprising a second spool valve fluidly coupled to the first spool valve to receive the downhole fluid when the first spool valve is in the second position and fluidly coupled to the setting line, wherein the second spool valve selectively moves from a third position to a fourth position at a higher fluid pressure than the first spool valve selectively moves to the second position.

17. The system of claim 14 wherein the first sampling chamber further comprises a mandrel to support the one or more filters and to allow the downhole fluid to flow to the second sampling chamber or the base block when the spool valve is in the second position.

18. The system of claim 17 wherein the mandrel comprises a fluid line to provide the fluid pressure to the setting line to move the spool valve to the second position.

19. The system of claim 17 wherein the mandrel comprises an equalizing line to fluidly couple the first sampling chamber to the second sampling chamber.

20. The system of claim 14 wherein the second sampling chamber comprises one or more filters to receive the downhole fluid from the spool valve, filter the downhole fluid, and store the downhole fluid.

21. The system of claim 20 wherein the one or more filters of the second sampling chamber are one or more cone-shaped filters.

22. The system of claim 14 wherein the first and second sampling chambers are mechanically coupled to an intermediate adaptor comprising the flow control member.

23. The system of claim 22 wherein the intermediate adaptor further comprises an equalization line to fluidly couple the first and second sampling chambers.

24. The system of claim 14 wherein the first sampling chamber is coupled to an upper block comprising the flow control member and wherein the first sampling chamber receives a sample fluid via the upper block when the flow control member is in the first position.

25. A method to filter and sample downhole fluids, comprising:

setting a first valve to a first position to allow downhole fluid to flow into a first sampling chamber;

filtering the downhole fluid via one or more filters in the first sampling chamber;

collecting the downhole fluid in the first sampling chamber;

applying a first pressure to the first valve to set the first valve to a second position to allow fluid to flow into a second sampling chamber, wherein the downhole fluid flows into the second sampling chamber via a second valve; and applying a second pressure to close the first valve and the second valve and to burst a pressure disk.

26. The method of claim 25 further comprising increasing the pressure on the second valve to change a position of the second valve.

27. The method of claim 26 wherein the pressure to set the second valve to the changed position is higher than the pressure to set the first valve to the second position.

28. The method of claim 25 wherein filtered downhole fluid flows out of the first or second sampling chamber via a check valve.

29. The method of claim 25 wherein applying the first pressure is in response to the downhole fluid substantially filling the first sampling chamber.

* * * * *